US009254683B2

(12) United States Patent
Akiyama et al.

(10) Patent No.: US 9,254,683 B2
(45) Date of Patent: Feb. 9, 2016

(54) IMAGE FORMING APPARATUS, IMAGE FORMING SYSTEM, IMAGE FORMING METHOD AND PRINTING METHOD OF PRINTED MATTER

(71) Applicants: Yoshitaka Akiyama, Kanagawa (JP); Yoshinari Suzuki, Kanagawa (JP); Yukihito Niino, Tokyo (JP); Kazuki Yasu, Kanagawa (JP); Seiya Murata, Kanagawa (JP); Honriku Jo, Kanagawa (JP)

(72) Inventors: Yoshitaka Akiyama, Kanagawa (JP); Yoshinari Suzuki, Kanagawa (JP); Yukihito Niino, Tokyo (JP); Kazuki Yasu, Kanagawa (JP); Seiya Murata, Kanagawa (JP); Honriku Jo, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/197,164

(22) Filed: Mar. 4, 2014

(65) Prior Publication Data

US 2014/0253651 A1 Sep. 11, 2014

(30) Foreign Application Priority Data

Mar. 6, 2013 (JP) ..... 2013-044664

(51) Int. Cl.
*B41J 2/01* (2006.01)
*B41J 11/00* (2006.01)

(52) U.S. Cl.
CPC ..... *B41J 11/0015* (2013.01)

(58) Field of Classification Search
CPC .. B41J 11/0015; B41J 2/2114; B41M 5/0011; B41M 5/0017; B41M 7/00–7/0054
USPC ..... 347/101
See application file for complete search history.

(56) References Cited

U.S. PATENT DOCUMENTS

| | | | | |
|---|---|---|---|---|
| 6,467,891 | B2 | 10/2002 | Moriyama et al. | |
| 6,513,924 | B1 * | 2/2003 | Goldberg et al. | 347/106 |
| 7,044,593 | B2 * | 5/2006 | Onishi | 347/101 |
| 7,338,143 | B2 * | 3/2008 | Onishi et al. | 347/19 |
| 7,497,540 | B2 * | 3/2009 | Mizutani et al. | 347/15 |
| 7,510,253 | B2 * | 3/2009 | Tatsumi | 347/14 |
| 7,806,514 | B2 * | 10/2010 | Kadomatsu et al. | 347/52 |
| 8,408,692 | B2 * | 4/2013 | Hirato et al. | 347/100 |
| 8,506,068 | B2 * | 8/2013 | Mimura | 347/100 |
| 8,579,429 | B2 * | 11/2013 | Itogawa | 347/101 |
| 2006/0250434 | A1 * | 11/2006 | Smith et al. | 347/17 |
| 2007/0222811 | A1 * | 9/2007 | Yanagi | 347/21 |
| 2009/0130320 | A1 * | 5/2009 | Kawakami et al. | 427/387 |

(Continued)

FOREIGN PATENT DOCUMENTS

| | | |
|---|---|---|
| EP | 0580283 B1 | 9/1999 |
| JP | 61-059911 | 3/1986 |

(Continued)

*Primary Examiner* — Jannelle M Lebron
*Assistant Examiner* — Jeremy Bishop
(74) *Attorney, Agent, or Firm* — Duft Bornsen & Fettig LLP

(57) ABSTRACT

An image forming apparatus discharges ink onto a recording medium to form an image on a surface of the recording medium. The image forming apparatus includes a preprocessing unit that applies preprocess liquid on the surface of the recording medium before the image is formed; and a postprocessing unit that applies postprocess liquid, which is different from the preprocess liquid, onto the recording medium after the image is formed. An application quantity of the preprocess liquid is determined based at least on a kind of the ink, and an application quantity of the postprocess liquid is determined based at least on the kind of the ink.

19 Claims, 12 Drawing Sheets

(56) References Cited

U.S. PATENT DOCUMENTS

2009/0295856 A1* 12/2009 Yoshida ..... 347/16
2012/0268544 A1* 10/2012 Munechika et al. ..... 347/118

FOREIGN PATENT DOCUMENTS

JP 06-071882 3/1994
JP 10-226055 8/1998

* cited by examiner

IMAGE FORMING APPARATUS, IMAGE FORMING SYSTEM, IMAGE FORMING METHOD AND PRINTING METHOD OF PRINTED MATTER

CROSS-REFERENCE TO RELATED APPLICATION

THE PRESENT APPLICATION IS BASED UPON AND CLAIMS THE BENEFIT OF PRIORITY OF JAPANESE PATENT APPLICATION NO. 2013-044664, FILED ON Mar. 6, 2013, THE CONTENTS OF WHICH ARE INCORPORATED HEREIN BY REFERENCE IN THEIR ENTIRETY

BACKGROUND OF THE INVENTION

1. Field of the Invention

The disclosures herein generally relate to an image forming apparatus, an image forming system, an image forming method and a printing method of printed matter.

2. Description of the Related Art

Image forming apparatuses include an ink-jet type image forming apparatus, having advantages in miniaturization and low-noise. In the ink-jet type image forming method, droplets of ink are discharged on a recording medium, to form an image on a surface of the recording medium.

Japanese Published Patent Application No. H10-226055 discloses an ink-jet recording apparatus (image forming apparatus), which distinguishes, when applying process liquid including an ingredient which insolubilizes or agglutinates an ingredient in ink, between a preprocess of discharging the process liquid onto the recording medium previously and discharging the ink, and a postprocess of discharging the ink onto the recording medium and then discharging the process liquid, and reduces difference between quality levels of the preprocessed part and the postprocessed part on the recording medium.

In the method disclosed in Japanese Published Patent Application No. H10-226055, on the surface of the recording medium the process liquid including an ingredient for insolubilizing or agglutinating is applied. However, there is a problem that when the surface of the recording medium, on which an image is formed, is grazed by another object (for example, another recording medium), the image on the recording medium may be peeled.

SUMMARY OF THE INVENTION

It is a general object of at least one embodiment of the present invention to provide an image forming apparatus, an image forming system, an image forming method and a printing method of printed matter that substantially obviates one or more problems caused by the limitations and disadvantages of the related art.

In one embodiment, an image forming apparatus, which discharges ink onto a recording medium to form an image on a surface of the recording medium, includes a preprocessing unit that applies preprocess liquid on the surface of the recording medium before the image is formed, an application quantity of the preprocess liquid being determined based at least on a kind of the ink; and a postprocessing unit that applies postprocess liquid, which is different from the preprocess liquid, onto the recording medium after the image is formed, an application quantity of the postprocess liquid being determined based at least on the kind of the ink.

In another embodiment, an image forming system includes an image forming apparatus, which discharges ink onto a recording medium to form an image on a surface of the recording medium, and includes a preprocessing unit that applies preprocess liquid on the surface of the recording medium before the image is formed, an application quantity of the preprocess liquid being determined based at least on a kind of the ink, and a postprocessing unit that applies postprocess liquid, which is different from the preprocess liquid, onto the recording medium after the image is formed, an application quantity of the postprocess liquid being determined based at least on the kind of the ink; an import device that imports the recording medium, before the image is formed, into the image forming apparatus; an export device that exports the recording medium, after the image is formed, from the image forming apparatus; and a control device that controls operations of the image forming apparatus, the import device and the export device by wired and/or wireless methods.

In yet another embodiment an image forming method includes applying preprocess liquid on a surface of a recording medium; forming an image with ink on the surface of the recording medium, on which the preprocess liquid is applied, an application quantity of the preprocess liquid being determined based at least on a kind of the ink; and applying postprocess liquid, which is different from the preprocess liquid, on the surface of the recording medium, on which the image is formed, an application quantity of the postprocess liquid being determined based at least on the kind of the ink.

In yet another embodiment, a printing method of printed matter, for performing printing on a recording medium with toner or ink, includes applying preprocess liquid on a surface of the recording medium, an application quantity of the preprocess liquid being determined based at least on a kind of the toner or the ink; forming an image on the surface of the recording medium with the toner or the ink, on which the preprocess liquid is applied; and applying postprocess liquid, which is different from the preprocess liquid, on the recording medium, on which the image is formed, an application quantity of the postprocess liquid being determined based at least on the kind of the toner or the ink.

According to the present invention, there are an image forming apparatus, an image forming system, an image forming method and a printing method of printed matter, in which an application quantity in a preprocess and an application quantity in a postprocess are controlled and optimized according to a kind of ink.

BRIEF DESCRIPTION OF THE DRAWINGS

Other objects and further features of embodiments will be apparent from the following detailed description when read in conjunction with the accompanying drawings, in which.

DESCRIPTION OF THE PREFERRED EMBODIMENTS

Figure 1:
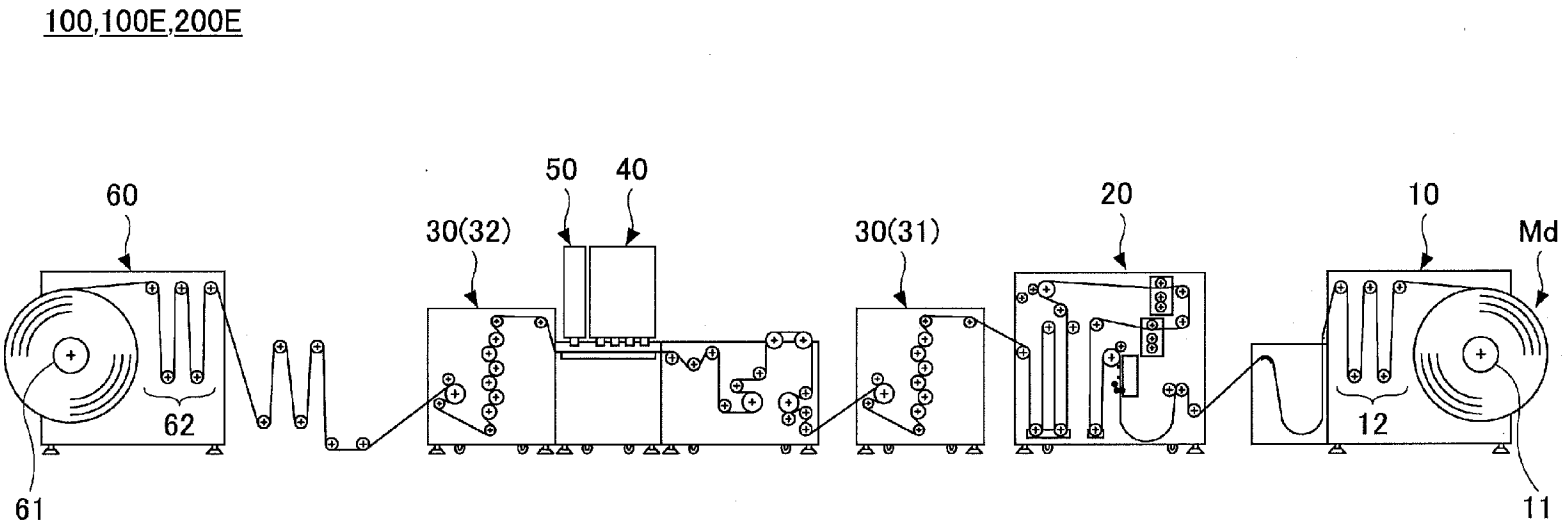
FIG. 1 is a diagram schematically illustrating an example of a side view of an image forming apparatus according to a present embodiment.

In the following, embodiments of the present invention will be described with reference to the accompanying drawings.

An unlimited exemplary embodiment of the present invention will be explained using an image forming apparatus including a preprocessing unit, an image forming unit and a postprocessing unit. The present invention can be applied not only to the image forming apparatus, which will be explained in the following, but also to any other device, apparatus, a unit system or the like, which forms an image on a recording device, such as an image recording apparatus, a combined apparatus, a printer, a scanner, a plotter, a facsimile apparatus, or the like. Here, the operation of forming an image on a surface of a recording medium includes printing, imaging, typing, recording or the like. Moreover, a recording medium, on which the image forming apparatus according to the present invention can form an image, includes an elongated medium, such as an elongated paper, an elongated form, an elongated thin paper, an elongated thick paper, and an elongated recording paper, an elongated OHP (Overhead Projector) sheet, an elongated synthetic resin film, an elongated metallic thin film or the like.

In the following, the same or corresponding numerical symbols are assigned to the same or corresponding members in the accompanying drawings, and duplicate explanation is omitted. Moreover, in the following explanations, an elongated recording medium will be denoted as a recording medium, for simplicity. Furthermore, the accompanying drawings do not aim at indicating a relative ratio between elements or parts. Accordingly, a specific size may be determined by a person skilled in the art in light of the descriptions in the unlimited embodiments in the following.

The present invention will be explained in the order of the following list, using the image forming apparatus according to the present embodiment of the present invention.

1. A configuration of an image forming apparatus;
2. An import unit;
3. A preprocessing unit;
4. A desiccation unit;
5. An image forming unit;
6. A postprocessing unit;
7. An export unit;
8. A control unit;
9. An image forming system;
10. A first example (image forming method); and
11. A second example (printing method of printed matter)

Configuration of Image Forming Apparatus

The image forming apparatus 100 according to the present embodiment of the present invention will be explained with reference to FIG. 1.

In the present embodiment, the image forming apparatus including a discharge head (record head or ink head), which discharges inks of four colors, i.e. black (K), cyan (C), magenta (M) and yellow (Y), will be explained. An image forming apparatus, to which the present invention can be applied, is not limited to the image forming apparatus having the above discharge head. That is, the image forming apparatus, to which the present invention can be applied, may further include a discharge head to deal with green (G), red (R), light cyan (LC), and/or other color, or only includes a discharge head for black (K). In the following explanations, a member, to which a numerical symbol having suffix K, C, M or Y is attached, deals with black, cyan, magenta or yellow ink, respectively.

Moreover, in the present embodiment, as a recording medium, a rolled up continuous paper (called a roll paper Md, in the following) is employed. A recording medium, on which an image can be formed by the image forming apparatus according to the present invention, is not limited to the roll paper. That is, the recording medium, on which an image can be formed by the image forming apparatus according to the present invention, may be a cut sheet. Here, the roll paper is a continuous paper, on which perforations, which can be cut, are formed at predetermined intervals (continuous business form). Moreover, a page in the roll paper is, for example, a region between the perforations formed at predetermined intervals.

As shown in FIG. 1, the image forming apparatus 100 according to the present embodiment includes an import unit 10 that imports a roll paper Md (recording medium), a preprocessing unit 20 that performs a preprocess for the imported roll paper Md, and a desiccation unit 30 (preprocess liquid desiccation unit 31) that desiccates the roll paper Md, for which the preprocessing unit has performed the preprocess. Moreover, the image forming apparatus 100 further includes an image forming unit 40 that forms an image on the roll paper Md, a postprocessing unit 50 that performs a postprocess for the roll paper Md on which the image is formed, and a desiccation unit 30 (postprocess liquid desiccation unit 32) that desiccates the roll paper Md, for which the postprocessing unit has performed the postprocess. Furthermore, the image forming apparatus 100 includes an export unit 60 that exports the roll paper Md, and a control unit 70 (shown later in FIG. 7) that controls the operation of the whole image forming apparatus 100.

The image forming apparatus 100 according to the present embodiment imports a roll paper Md by the import unit 10, and performs the preprocess for a surface of the roll paper Md by the preprocessing unit 20 and desiccates the surface of the roll paper Md by the preprocess liquid desiccation unit 31 (desiccation unit 30). Moreover, the image forming apparatus 100 forms an image on the preprocessed and desiccated surface of the roll paper Md by the image forming unit 40. Furthermore, the image forming apparatus 100 performs the postprocess for the surface of the roll paper Md by the postprocessing unit 50 and desiccates the surface of the roll paper Md by the postprocess liquid desiccation unit 32 (desiccation unit 30). Afterward, the image forming apparatus rolls up (discharges or exports) the roll paper Md. The image forming apparatus 100 according to the present embodiment, controls operations of the preprocessing unit 20, the desiccation unit 30 (preprocess liquid desiccation unit 31 and the postprocess liquid desiccation unit 32), and the postprocessing unit 50, according to a kind of ink (pigment) used when the image is formed on the surface of the recording medium.

In the following, each member included in the image forming apparatus 100 according to the present embodiment will be specifically explained. The configuration of the image forming apparatus, to which the present invention can be applied, may not include at least one of the preprocessing unit 20 and the like, as described later, according to the kind of ink (pigment) to form an image, or a kind of recording medium on which an image is formed. Furthermore, the configuration of the image forming apparatus, to which the present invention can be applied, may not include, for example, the desiccation unit 30.

Import Unit

The import unit transports the recording medium to the preprocessing unit 20 or the like. The import unit 10 according to the present embodiment, includes a paper feed unit 11, plural feed rollers 12 and the like. The import unit 10, using the feed rollers 12 or the like, imports (moves) a roll paper, wound around a feed paper roll and held in the paper feed unit 11, and transports the roll paper to the preprocessing unit 20, which will be explained later.

Preprocessing Unit

The preprocessing unit 20 performs a process for the recording medium before an image is formed. In the present embodiment, the preprocessing unit performs a preprocess for the surface (double side) of the roll paper Md transported by the import unit 10 with preprocess liquid. The preprocess is a process of applying uniformly on the surface of the roll paper Md (recording medium) the preprocess liquid which has a function of agglutinating ink, which will be described later.

The image forming apparatus 100 according to the present embodiment controls a quantity of application of the preprocess liquid according to a kind of the ink (pigment) used for forming an image on the recording medium, by using the preprocessing unit 20. Moreover, the image forming unit 100, in the case of forming an image on a recording medium, other than the ink-jet dedicated paper, for example, applies on the surface of the recording medium the preprocess liquid having the function of agglutinating the ink, by using the preprocessing unit 20, before forming the image on the recording medium.

Accordingly, the image forming apparatus 100 can reduce an occurrence of a problem of quality, such as blurring of a formed image, density, color tone, or strike through, and a problem relating to toughness of image, such as water resistance or weather resistance. That is, the image forming apparatus 100, by applying the preprocess liquid having a function of agglutinating the ink by using the preprocessing unit 20 before an image is formed on the recording medium, can enhance the quality of an image formed afterward. Moreover, the image forming apparatus 100, by applying the preprocess liquid, which is in the condition optimized according to the kind of the ink, can suppress a degradation of printing quality due to insufficient desiccation or an occurrence of shrinkage of paper due to an excess of desiccation. Accordingly, the image forming apparatus 100 can form an image which is of high quality and has high toughness. Furthermore, with the image forming apparatus 100, by controlling the quantity of application of the preprocess liquid according to the kind of the ink, the toughness of an image can be maintained for the ink which requires a large quantity of the preprocess liquid, and the cost can be further reduced for the ink which requires a small quantity of the preprocess liquid.

The image forming unit 100, by using the preprocessing unit 20, may apply the preprocess liquid having the function of agglutinating ink on the ink-jet dedicated paper (recording medium), before forming an image.

For the preprocessing unit 20 according to the present embodiment, as the preprocess method, for example, a blade coating method, a gravure offset coating method, a bar-coating method, a roll coating method, a knife coating method, an air knife coating method, a comma coating method, a U comma coating method, an AKKU coating method, a smoothing coating method, a micro gravure coating method, a reverse roll coating method, a 4- to 5-rolls coating method, a dip coating method, a curtain coating method, a slide coating method, or a dye coating method may be used.

Moreover, the preprocessing unit 20 according to the present embodiment may use, as the preprocess liquid, for example, process liquid including hydrosoluble aliphatic organic acid. The process liquid including hydrosoluble aliphatic organic acid has a function of agglutinating ink. The term "agglutinating" means absorbing and aggregating water dispersible colorant particles.

Furthermore, the preprocessing unit 20 can absorb ions on surfaces of the water dispersible colorant by adding ionic material, such as hydrosoluble aliphatic organic acid or the like, to the preprocess liquid. Accordingly, the preprocessing unit 20 can neutralize charges on the surfaces of the water dispersible colorant. Moreover, the preprocessing unit 20 can increase the agglutinative action by intermolecular force, and can further aggregate the water dispersible colorant.

Figure 2:
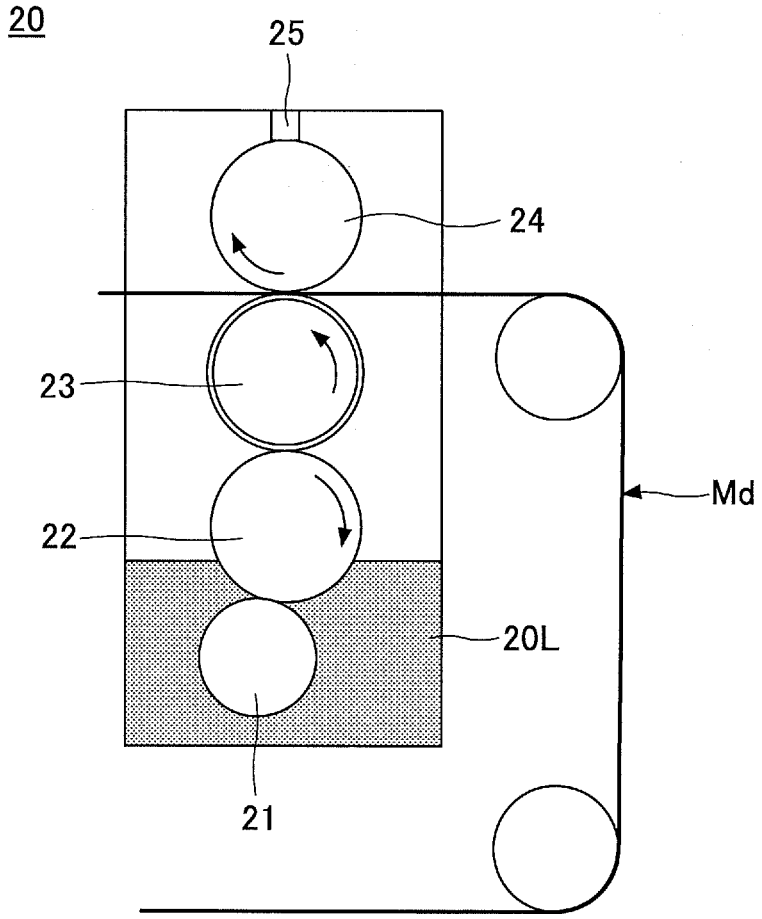
FIG. 2 is a diagram schematically illustrating an example of a configuration of a preprocessing unit in the image forming apparatus according to the present embodiment.

With reference to FIG. 2, an example of the preprocessing unit 20 using the roll coat method will be explained in the following.

As shown in FIG. 2, the preprocessing unit 20 according to the present embodiment applies accumulated preprocess liquid 20L onto a surface of a roll paper Md, which is imported (transported) into the preprocessing unit 20 by the import unit 10 (See FIG. 1).

Specifically, the preprocessing unit 20, at first, by a stir (provision) roller 21 and a lamination (transportation) roller 22, transcribes (transfers) the preprocess liquid 20L thinly on a surface of an application roller 23. Next, the preprocessing unit 20 presses the application roller 23 onto a revolving platen roller 24, and rotates the application roller 23. The preprocessing unit 20, then, by transporting the roll paper Md into a nip between the application roller 23 and the platen roller, can apply the preprocess liquid 20L on the surface of the roll paper Md.

Moreover, the preprocessing unit 20, by using a pressure adjustment unit 25, controls a nip pressure (pressure acting at a position where the application roller 23 contacts the platen roller 24) when the preprocess liquid is applied. Accordingly, the preprocessing unit 20, by changing the nip pressure by using the pressure adjustment unit 25, can control (change) an application quantity (a film thickness, a quantity of liquid, an adherence quantity, a dried adherence quantity, or the like) of the preprocess liquid 20L.

Furthermore, the preprocessing unit 20 controls rotational speeds of the application roller 23 and of the platen roller 24. Accordingly, the preprocessing unit 20, by changing the rotational speed of the application roller 23 or the like, can control (change) the application quantity of the preprocess liquid 20L. Meanwhile, the preprocessing unit 20 may control the rotational speed of the application roller 23 or the like by, for example, controlling an operation of a power source (not shown), such as a drive motor, which drives the application roller 23 and the platen roller 24.

As stated above, the preprocessing unit 20 of the image forming apparatus 100 according to the present embodiment, compared with the case of applying preprocess liquid on a recording medium by using a jet head, can apply the preprocess liquid uniformly on the roll paper Md (recording medium). That is, the preprocessing unit 20 according to the present embodiment, even in the case of preprocess liquid with relatively high viscosity, can apply the preprocess liquid on the roller paper Md thinly and uniformly. Moreover, the preprocessing unit 20 according to the present embodiment can apply the preprocess liquid on the roller paper Md thinly and uniformly, and can suppress a blurring of an image, which is formed afterward, or the like. Furthermore, since the preprocessing unit 20 according to the present embodiment can apply the preprocess liquid on the roll paper Md thinly and uniformly and can suppress the blurring of the image which is formed afterward or the like, the quality of image can be enhanced.

Moreover, the preprocessing unit 20 of the image forming apparatus 100 according to the present embodiment can control the application quantity (the film thickness, the quantity of liquid, the adherence quantity, the dried adherence quantity, or the like) of the preprocess liquid applied by using the application roller 23 or the like, and the preprocess liquid 20L of the application quantity, which is appropriate for forming an image afterward and for the postprocess, on the surface of the roll paper Md (recording medium).

Furthermore, since the preprocessing unit 20 of the image forming apparatus 100 according to the present embodiment can control the application quantity of the preprocess liquid to be applied by using the application roller 23 or the like, the application quantity of the preprocess liquid can be controlled according to the kind of the ink (pigment) used for forming the image on the surface of the recording medium. Moreover, since the preprocessing unit 20 according to the present embodiment can control the application quantity of the preprocess liquid applied by using the application roller 23 or the like, the application quantity of the preprocess liquid can be controlled according to the kind of the recording medium. That is, since the preprocessing unit 20 according to the present embodiment can control the application quantity of the preprocess liquid, the quality of a formed image can be enhanced and the cost can be reduced.

Desiccation Unit

The desiccation unit 30 desiccates the recording medium by heat or the like. As shown in FIG. 1, the desiccation unit 30 according to the present embodiment includes a preprocess liquid desiccation unit 31, which desiccates the roll paper Md preprocessed by the preprocessing unit 20, and a postprocess liquid desiccation unit 32, which desiccates the roll paper Md postprocessed by the postprocessing unit 50.

The desiccation unit 30 of the image forming unit 100 according to the present embodiment controls preprocess liquid desiccation intensity of the preprocess liquid desiccation unit 31 and postprocess liquid desiccation intensity of the postprocess liquid desiccation unit 32 according to the kind of ink (pigment) used for forming an image on the surface of the recording medium, and desiccates the roll paper Md.

Figure 3:
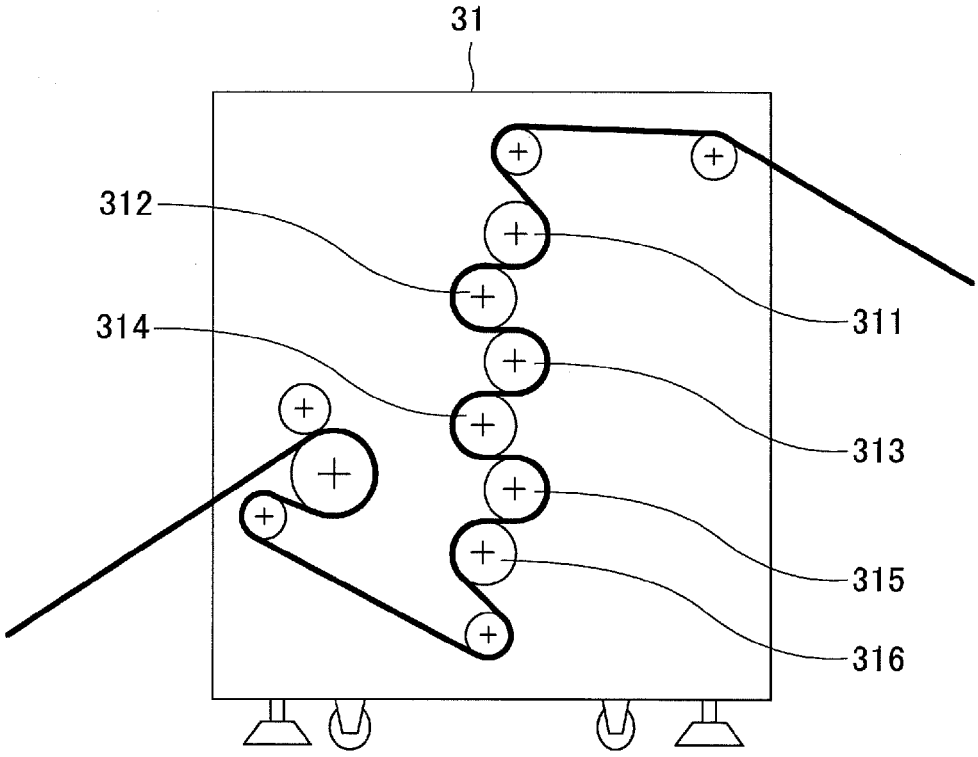
FIG. 3 is a diagram schematically illustrating an example of a configuration of a desiccation unit in the image forming apparatus according to the present embodiment.

With reference to FIG. 3, the configuration of the preprocess liquid desiccation unit 31 will be explained in the following.

As shown in FIG. 3, the preprocess liquid desiccation unit 31 includes plural heat rollers 311 to 316 so as to enhance the desiccation effect. Moreover, the preprocess liquid desiccation unit 31 controls (changes) the desiccation intensity (preprocess liquid desiccation intensity) according to the kind of ink (pigment) used for forming an image on the surface of the recording medium. Furthermore, the preprocess liquid desiccation unit 31 controls the desiccation intensity further using the application quantity per unit area of the surface of the recording medium applied by the preprocessing unit 20.

Specifically, the preprocess liquid desiccation unit 31 heats the heat roller (311 or the like) to, for example, 40 to 100° C., and makes the surface of the roll paper Md, on which the preprocess liquid is applied, contact the heat roller (311 or the like) or the like. Accordingly, the preprocess liquid desiccation unit 31 can heat the surface of the roll paper Md, on which the preprocess liquid is applied, by the heat roller (311 or the like), evaporate water in the preprocess liquid, and desiccate the roll paper Md (or the preprocess liquid).

Moreover, the preprocess liquid desiccation unit 31, in the case of decreasing the desiccation intensity, lowers the temperature of the heat roller (311 or the like). The preprocess liquid desiccation unit 31 decreases the desiccation intensity in the case of using ink with low permeability, and increases the desiccation intensity in the case of using ink with high permeability. The preprocess liquid desiccation unit 31 sets the temperature of the heat roller (311 or the like) to, for example, 40 to 80° C.

Furthermore, the preprocess liquid desiccation unit 31 may increase or decrease the desiccation intensity by increasing or decreasing the number of heat rollers used for heating, for example, by heating only the heat rollers 311 and 312, and not heating other heat rollers. In the present embodiment, the example of controlling the temperature of heat rollers and the numbers of heat rollers used for heating is explained. However, the desiccation intensity may be controlled by either of the temperature or the number of the heat rollers.

The configuration of the postprocess liquid desiccation unit 32 is the same as the preprocess liquid desiccation unit 31, and the explanation is omitted. The postprocess liquid desiccation unit 32 controls desiccation intensity (postprocess liquid desiccation intensity) according to the kind of ink (pigment). Moreover, the postprocess liquid desiccation unit 32 controls the desiccation intensity further using the discharge quantity per unit area of the surface of the recording medium discharged by the postprocessing unit 50. Furthermore, the postprocess liquid desiccation unit 32 decreases the desiccation intensity in the case of using ink with low permeability, and increases the desiccation intensity in the case of using ink with high permeability.

As stated above, the desiccation unit 30 of the image forming apparatus 100, according to the present embodiment (the preprocess liquid desiccation unit 31 and the postprocess liquid desiccation unit 32), can control the desiccation intensity by a combination of the temperature of heat rollers and/or the number of the heat rollers to be used. Moreover, since the desiccation unit 30 of the image forming apparatus 100, according to the present embodiment, can control the desiccation intensity, the desiccation intensity for the recording medium can be optimized according to the kind of ink (pigment) used for forming an image on the surface of the recording medium. Furthermore, the desiccation unit 30 of the image forming apparatus 100 according to the present embodiment, by controlling the preprocess liquid desiccation intensity based on the kind of ink, can suppress an occurrence of degradation of image quality due to insufficient desiccation for the preprocess liquid or an occurrence of shrinkage of paper due to an excess of desiccation. That is, the image forming apparatus 100 according to the present embodiment can enhance the image forming quality (print quality).

Moreover, the desiccation unit 30 of the image forming apparatus 100 according to the present embodiment, by controlling the postprocess liquid desiccation intensity based on the kind of ink, can suppress a degradation of the toughness of image due to insufficient desiccation for the postprocess liquid, and the image quality can be enhanced. Furthermore, the desiccation unit 30 of the image forming apparatus 100 according to the present embodiment, by controlling the postprocess liquid desiccation intensity based on the kind of ink, can suppress shrinkage of paper due to an excess of desiccation.

In the ink-jet type image forming apparatus, in the case of discharging droplets on a recording medium under the same condition, in order to maintain constant a physical property, such as viscosity, surface tension or the like, ink may be prepared with various additives, such as glycerin. For this reason, in the image forming apparatus, in the case of using the ink prepared as above, permeability of ink in a recording medium or glossiness after printing may be different. By the desiccation unit 30 of the image forming apparatus 100 according to the present embodiment, even if ink with low permeability in the recording medium is used for the image forming, the preprocess liquid or the postprocess liquid can be sufficiently removed. The desiccation unit 30 according to the present embodiment can prevent the occurrence of the problem that an image on the recording medium may be peeled when the surface of the recording medium is grazed by another object (for example, another recording medium) before the preprocess liquid is removed. Moreover, the desiccation unit 30 according to the present embodiment can prevent the shrinkage of the recording medium due to the excess of desiccation when ink with high permeability in the recording medium is used for the image forming, and enhance the quality of image forming (quality of print).

A heater unit in the desiccation unit 30, to which the present invention is applied, is not limited to the heat rollers. That is, the desiccation unit 30 may employ an infrared ray desiccation method, a microwave desiccation method, a hot-air desiccation method or any other desiccation methods. Moreover, the desiccation unit 30 may employ a combination of desiccation methods. Furthermore, the desiccation unit 30 may preheat (heat) the roll paper Md (recording medium) before the application of the preprocess liquid by the preprocessing unit 20 (preheat step (not shown)).

Image Forming Unit

The image forming unit 40 forms an image on a recording medium. The image forming unit 40 according to the present embodiment forms an image on a surface of a roll paper Md by discharging droplets (ink) onto the roll paper Md, which is desiccated by the desiccation unit 30.

Figure 4A:
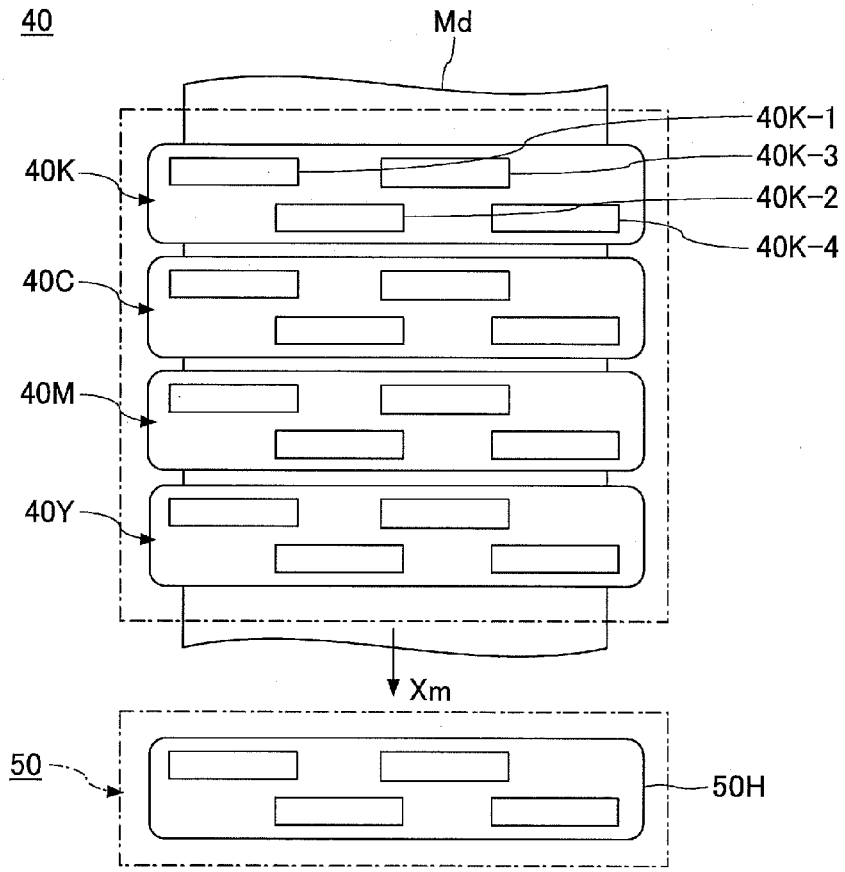
FIGS. 4A and 4B are explanatory diagrams illustrating examples of an image forming unit and a postprocessing unit in the image forming apparatus according to the present embodiment.
Figure 4B:
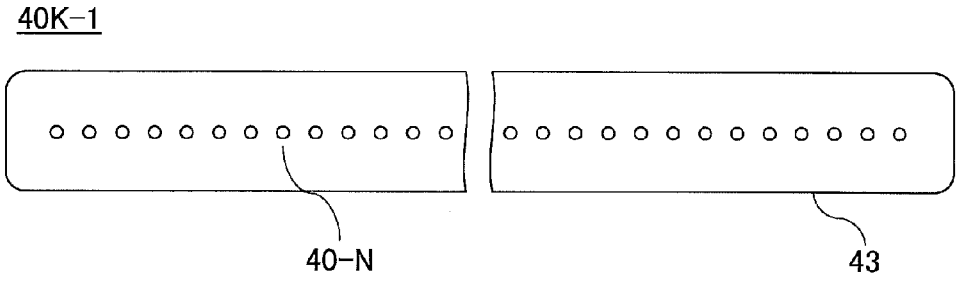

With reference to FIGS. 4A and 4B, an example of the image forming unit 40 will be described. FIG. 4A is a diagram schematically illustrating a plan view of an example of the whole configuration of the image forming unit 40 (and the postprocessing unit 50) of the image forming apparatus according to the present embodiment. FIG. 4B is a diagram illustrating an enlarged plan view of an example of a main part (discharge head 40K of black ink (K)) of the image forming unit 40.

As shown in FIG. 4A, the image forming unit 40 according to the present embodiment may use a head (discharger) of a full line type. That is, in the image forming unit 40, four discharge heads 40K, 40C, 40M and 40Y, which deal with black ink (K), cyan ink (C), magenta ink (M) and yellow ink (Y), respectively, are arranged from an upstream side of the transportation direction Xm for the recording medium.

The discharge unit 40K for black ink (K) according to the present embodiment includes four head units 40K-1, 40K-2, 40K-3 and 40K-4, arranged in a staggered manner in a direction orthogonal to the transportation direction Xm for the roll paper Md. Accordingly, the image forming unit 40 can form an image in the entire area in the width direction (orthogonal to the transporting direction) of the image forming region (print region) of the roll paper Md (recording medium). The other discharge heads 40C, 40M and 40Y have the same configuration as the discharge head 40K for black ink (K), and an explanation is omitted.

As shown in FIG. 4B, the head unit 40K-1 according to the present embodiment includes plural discharge ports (nozzles or print nozzles) 40-N on a nozzle face (outer surface of a nozzle plate 43 in FIG. 5A, which will be described later). The plural nozzle ports 40-N are arranged in a line in a longitudinal direction of the head unit 40K-1, and form a nozzle array. The head unit 40K-1 may include plural nozzle arrays.

A cross-sectional shape of the discharge head of the image forming unit 40 will be explained with reference to FIGS. 5A and 5B. FIG. 5A is a diagram schematically illustrating a cross-sectional view of an example of a flow path (cross section in the longitudinal direction of a liquid chamber 40-F). FIG. 5B is a cross-sectional view illustrating an arrangement of the discharge ports 40-N of the image forming unit 40, which is a cross section along a line SC1 in FIG. 5A in a lateral direction of the liquid chamber 40-F (in the arrangement direction of the discharge ports).

Figure 5A:
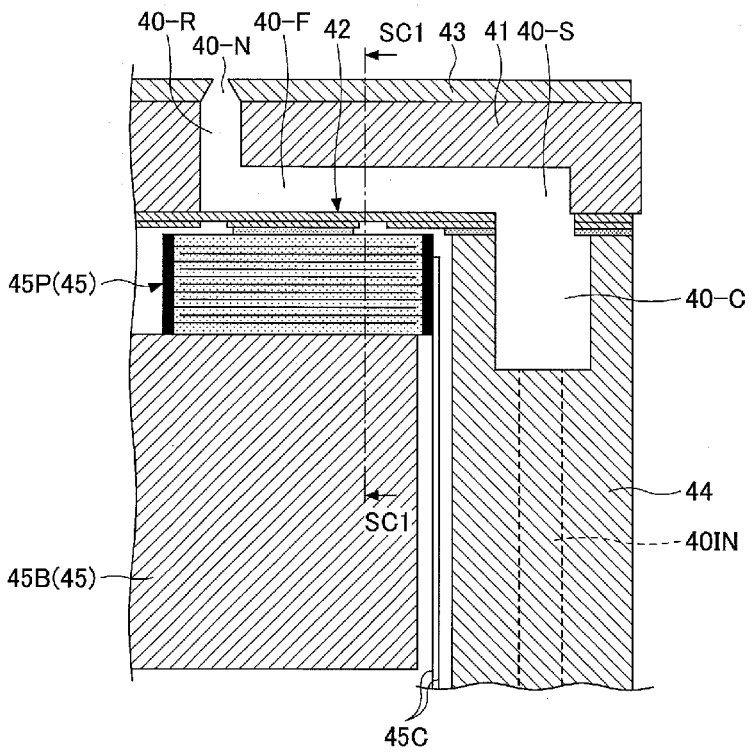
FIGS. 5A and 5B are cross-sectional diagrams schematically illustrating an example of the image forming unit in the image forming apparatus according to the present embodiment.
Figure 5B:
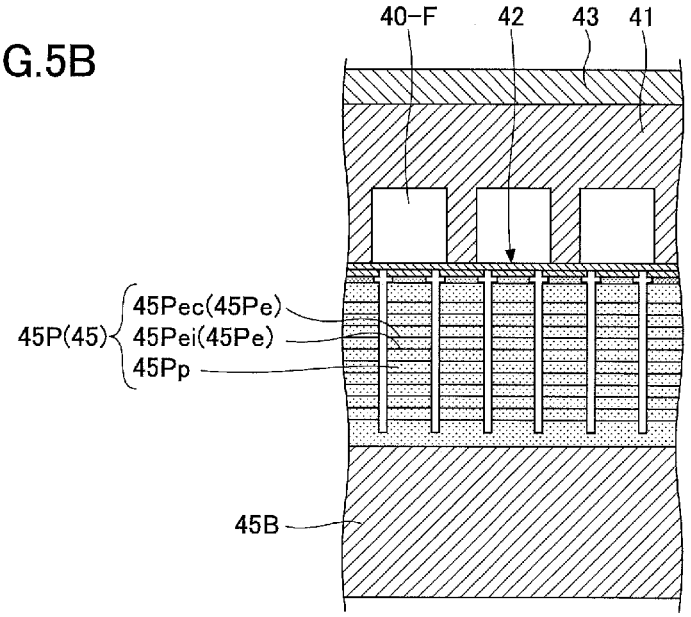

As shown in FIG. 5A, the discharge head 40K (40C, 40M or 40Y) includes a flow path plate 41, which forms a path for ink to be discharged, a vibration plate 42, joined to a lower surface of the flow path plate 41 (in an inward direction of the discharge head 40K), the nozzle plate 43, joined to an upper surface of the flow path plate 41 (in an outward direction of the discharge head 40K), and a frame member 44, which holds a peripheral part of the vibration plate 42. Moreover, the discharge head 40K includes a pressure generation unit (actuator unit) 45, which deforms the vibration plate 42.

The discharge head 40K (40C, 40M or 40Y) according to the present embodiment can form a nozzle communication path 40-R, which is a path communicating with the discharge port 40-N (nozzle), and the liquid chamber 40-F, by laminating the flow path plate 41, the vibration plate 42 and the nozzle plate 43. Moreover, the discharge head 40K can form an inflow port 40-S, which provides ink to the liquid chamber 40-F, and a common liquid chamber 40-C, which holds ink to be provided to the liquid chamber 40-F, by further laminating the frame member 44. Furthermore, the discharge head 40K can deform (deflection deformation) the vibration plate by using the pressure generation unit 45. Accordingly, the discharge head 40K can change a volume to contain ink of the liquid chamber 40-F, and change a pressure applied to the ink in the liquid chamber 40-F. As a result, the discharge head 40K can discharge ink from the discharge port 40-N.

For the flow path plate 41, a single-crystal silicon substrate having a crystal orientation (110) may be used. By performing anisotropic etching of the flow path plate 41 by using an alkaline etching liquid such as potassium hydroxide aqueous solution (KOH), a concave portion and a hole portion, which become the nozzle communication path 40-R and the liquid chamber 40-F, can be formed. The material used for the flow path plate 41 is not limited to the single-crystal silicon substrate. That is, for the flow path plate 41, a stainless steel substrate, photo-sensitive resin or the like may be used.

For the vibration plate 42, a metal plate of nickel may be used. Accordingly, the vibration plate 42 can be processed by nickel electroforming (for example, the electroforming method). Moreover, for the vibration plate 42, a metal plate other than the nickel metal plate, or jointed material of metal and resin may be used.

For the nozzle plate 43, a single-crystal silicon substrate can be used. The nozzle plate 43 can be processed using the anisotropic etching as for the flow path plate 41. On the nozzle plate 43, on the outer surface of the metallic member a water-shedding layer may be formed via a required layer. Moreover, the nozzle plate 43 according to the present embodiment, includes plural nozzles 40-N for discharging droplets (ink drops). Specifically, in the nozzle plate 43, the nozzles 40-N having diameters of 10 to 30 μm corresponding to the liquid chambers 40-F are formed.

For the frame member 44, thermosetting resin (for example, epoxy type resin) or polyphenylene sulfite (PPS) may be used. Accordingly, the frame member 44 can be processed by injection forming. Moreover, in the frame member 44 according to the present embodiment, there are an accommodation part, which includes the pressure generation unit 45, a concave portion, which becomes the common liquid chamber 40-C and an ink provision port 401N, which provides ink to the common liquid chamber 40-C from outside the discharge head 40K.

For the pressure generation unit 45, electromechanical transducer elements can be used. The pressure generation unit 45 according to the present embodiment includes piezoelectric elements 45P, which are the electromechanical transducer elements, a base substrate 45B, which joins and fixes the piezoelectric elements 45P, and prop members which are arranged in gaps between the neighboring piezoelectric elements 45P. Moreover, the pressure generation unit 45 further includes an FPC (flexible printed circuit) cable 45C, which connects the piezoelectric elements 45P to a drive circuit (drive IC), which is not shown.

For the piezoelectric element 45P, as shown in FIG. 5B, there is a laminated type piezoelectric transducer (PZT), in which piezoelectric material 45Pp and internal electrodes 45Pe are alternately laminated.

The internal electrode 45Pe includes plural individual electrodes 45Pei and plural common electrodes 45Pec. The individual electrodes 45Pei and the common electrodes 45Pec, in the internal electrode 45Pe according to the present embodiment are alternately joined to the end surfaces of the piezoelectric material 45Pp.

Moreover, in the piezoelectric element 45P according to the present embodiment, for the piezoelectric direction of the piezoelectric material 45Pp, a d33 direction is used. The pressure generation unit 45, using the piezoelectric effect of the piezoelectric element 45P (displacement in the direction of d33), can increase and decrease the pressure applied on the ink in the liquid chamber 40-F. The pressure generation unit 45 may increase and decrease the pressure applied onto the ink in the liquid chamber 40-F, by using a displacement in the direction of d33. Moreover, in the pressure generation unit 45, a line of piezoelectric elements 45P may be arranged for one discharge port 40-N.

The prop members may be formed at the same time as the piezoelectric elements 45P are formed, by dividing the piezoelectric element member into plural piezoelectric elements 45P. That is, in the discharge head 40K, alternate piezoelectric elements 45P are used as the prop members by not applying electric voltage to those piezoelectric elements 45P.

In the following, the operation of discharging ink (pull out or push out operation) from the nozzle 40-N of the discharge head 40K will be specifically explained.

The discharge head 40K according to the present embodiment, at first, lowers the voltage applied on the piezoelectric element 45P (pressure generation unit 45) from the standard potential, and reduces a size of the piezoelectric element 45P in the laminating direction. Moreover, the discharge head 40K deforms the vibration plate 42 so as to be deflected according to the shrinkage of the piezoelectric element 45P. Then, the discharge head 40K enlarges (expands) the volume to contain ink of the liquid chamber 40-F according to the deflection deformation of the vibration plate 42. Accordingly, the discharge head 40K can allow ink to flow into the liquid chamber 40-F from the common liquid chamber 40-C.

Next, the discharge head 40K raises the voltage applied on the piezoelectric element 45P, and extends the piezoelectric element 45P in the laminating direction. Moreover, the discharge head 40K deforms the vibration plate 42 toward the nozzle 40-N according to the extension of the piezoelectric element 45P. Then, the discharge head reduces (shrinks) the volume to contain ink of the liquid chamber 40-F. Accordingly, the discharge head 40K can apply pressure on the ink in the liquid chamber 40-F. Moreover, the discharge head 40K can discharge (eject) the ink from the discharge port 40-N by applying pressure on the ink.

Then, the discharge head 40K returns the voltage applied on the piezoelectric element 45P to the standard potential, and returns (restores) the vibration plate 42 to the initial position. The discharge head 40K reduces the pressure in the liquid chamber 40-F according to the expansion of the liquid chamber 40-F, and fills the liquid chamber 40-F with ink from the common liquid chamber 40-C. Next, the discharge head 40K, after a vibration of a meniscus face of the nozzle 40-N is damped (stabilized), proceeds to the operation of discharging next ink, and the above operation is repeated.

The drive method of the discharge head 40K, to which the present invention can be applied, is not limited to the above example, i.e. the pull out and push out operations. That is, the method of driving the discharge head 40K can perform the pull-out or the push-out by controlling the voltage (drive waveform) applied to the piezoelectric element 45P.

As stated above, the image forming apparatus 100 according to the present embodiment, using the image forming unit 40, including four discharge heads 40K, 40C, 40M and 40Y, by one transportation operation of the recording medium (roll paper Md), can form a monochrome or full color image in the entire area of the image forming region.

The pressure generation unit 45, to which the present invention can be applied, is not limited to the above example, i.e. the piezoelectric element 45P. That is, the pressure generation unit 45 may employ the method of heating ink in the liquid chamber 40-F, to generate air bubbles (the so called thermal type). See, for example, Japanese Published Patent Application No. S61-59911. Moreover, the pressure generation unit 45 may employ the method of deforming the vibration plate by an electrostatic force between the vibration plate and an electrode, which is arranged on a wall of the liquid chamber 40-F, so that the electrode faces the vibration plate (the so called electrostatic type). See, for example, Japanese Published Patent Application No. H6-71882.

Postprocessing Unit

The postprocessing unit 50 performs a process for the recording medium after an image is formed. The postprocessing unit 50 according to the present embodiment performs the postprocess with postprocess liquid for the surface of the roll paper Md, on which the image forming unit 40 has formed an image.

Figure 6:
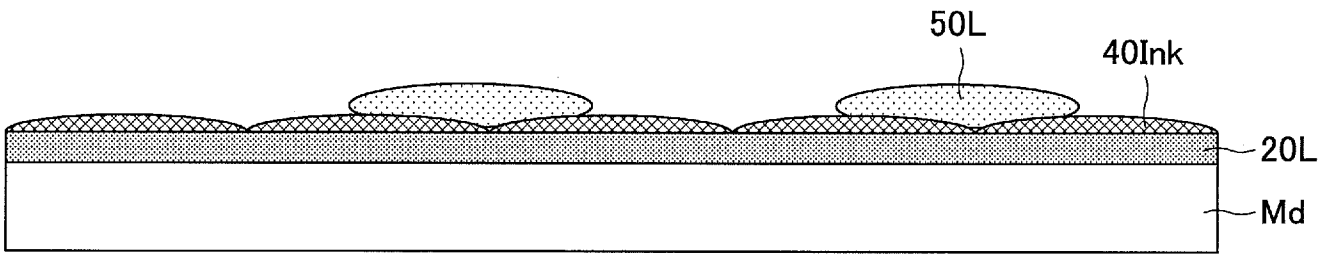
FIG. 6 is an explanatory diagram illustrating an example of a recording medium (a product or a printed matter) after an image is formed by the image forming apparatus according to the present embodiment.

With reference to FIGS. 4A, 4B and 6, an example of the postprocessing unit 50 will be described. FIG. 6 is an explanatory diagram illustrating an example of a recording medium (product produced by the image forming method according to the present invention) after an image is formed by the image forming apparatus 100 according to the present embodiment.

As shown in FIG. 4A, the postprocessing unit 50 is arranged on the downstream side of the image forming unit 40 in the transportation direction Xm of the recording medium. Moreover, the postprocessing unit 50, in the same way as the image forming unit 40, includes a discharge head 50H (discharger), which is arranged in the direction perpendicular to the transportation direction Xm of the roll paper Md. The discharge head 50H includes four head units arranged in a staggered manner in a direction orthogonal to the transportation direction Xm for the roll paper Md. Furthermore, the postprocessing unit 50, by controlling the drive waveform, which is input to the discharge head 50H, controls a discharge quantity of the postprocess liquid. Accordingly, the postprocessing unit 50, using the discharge head 50H, can discharge the postprocess liquid in an entire area of the image forming region (print region) of the roll paper Md (recording medium) in the width direction (perpendicular to the transportation direction). A configuration of the discharge head 50H is the same as the configuration of the image forming unit 40 (See FIGS. 4*a* to 5B), and the explanation is omitted.

The postprocess is a process of discharging (depositing) the postprocess liquid, which will be described later, on the roll paper Md (recording medium). The postprocess liquid is formed in a spot shape, a stripe shape or the like. Accordingly, the rub resistance, the glossiness, and the preservation stability (the water resistance, the light resistance, and the gas resistance) or the like of the recording medium, on which an image is formed, can be enhanced. For example, as shown in FIG. 6, at the time of starting the postprocess of the postprocessing unit 50, on the roll paper Md (product), the preprocess liquid 20L is applied on the surface, and the ink 40Ink to form an image is further discharged. The postprocessing unit 50 of the image forming unit 100 according to the present embodiment, as the postprocess, performs a process of discharging (depositing) the postprocess liquid 50L on the roll paper Md, on which an image is formed.

Moreover, the postprocessing unit 50 according to the present embodiment may discharge the postprocess liquid in an area smaller than the surface area of the recording medium, on which the preprocess liquid is applied. Furthermore, the postprocessing unit 50, at least in a part where an image is formed on the recording medium, may discharge the postprocess liquid in an area smaller than the surface area, on which the image is formed.

FIG. 6 is a diagram schematically illustrating a cross-sectional view of the recording medium. The postprocess liquid 50L is discharged (deposited) in an area at least smaller than the preprocess liquid 20L. Moreover, the cross-sectional view shows that the ink 40Ink is discharged in the entire area, and the postprocess liquid 50L is discharged (deposited) in an area smaller than the area of the ink. FIG. 6 shows that the postprocess liquid 50L seems to form a spot shape. The form of the postprocess liquid may be a stripe shape, which is perpendicular to the cross-section.

As shown in FIG. 6, the postprocess liquid 50L, at least in the part where the image is formed on the recording medium, may be discharged (deposited) in an area smaller than the surface area on which the image is formed. Moreover, the postprocess liquid 50L, in the area where the image is not formed, may be discharged (deposited) or may not be discharged (deposited).

In the case where the recording medium, formed in the shape as shown in FIG. 6, is grazed by another medium, a surface part of the postprocess liquid 50L is grazed. Accordingly, a peeling of the image (ink) can be prevented for not only the ink 40Ink in the part where the postprocess liquid is deposited but also the ink 40Ink in the part where the postprocess liquid is not deposited.

As described above, the image forming apparatus 100 according to the present invention, using the postprocessing unit 50, can deposit (discharge) the postprocess liquid (postprocess liquid 50L) on the recording medium (roll paper Md) on which an image is formed. Accordingly, compared with the case where the postprocess liquid is not deposited, the image forming apparatus according to the present invention can prevent the peeling of the image (ink) on the recording medium due to the grazing of the surface of the recording medium (roll paper Md), on which the image is formed, with another object (for example, another recording medium). That is, the image forming apparatus 100 according to the present embodiment can enhance the rub resistance (abrasion resistance) of an image formed on the recording medium by using the postprocessing unit 50.

Moreover, the image forming apparatus 100 according to the present embodiment, using the postprocessing unit 50, can deposit (discharge) the postprocess liquid on the recording medium (roll paper Md), on which the image is formed, and can enhance the quality of the image formed on the recording medium. That is, the image forming apparatus 100, by using the postprocessing unit 50, can deposit the postprocess liquid on the recording medium on which an image is formed, and can reduce an occurrence of the problem of quality, such as the blurring of the formed image, density, color tone, glazing, or strike through, and the problem relating to the toughness of image, such as the water resistance or the weather resistance.

The postprocessing unit 50 of the image forming apparatus 100 according to the present embodiment, as the postprocess method, preferably deposits (discharges) the postprocess liquid only in a specific part within the region where an image is formed on the roll paper Md. The postprocessing unit 50 discharges the postprocess liquid, a discharge quantity of which is determined based on the kind of ink (pigment) used for forming the image on the recording medium. The postprocessing unit 50 preferably changes the discharge quantity of the postprocess liquid and the method of discharge (application) based on the kind, the permeability, the glossiness and/or the resolution of the recording medium and/or the quantity of application of the preprocess liquid (quantity of liquid), which the preprocessing unit 20 applies.

Moreover, the postprocessing unit 50 according to the present embodiment, using the discharge head, can discharge the postprocess liquid in an arbitrary area (at an arbitrary point), with a desired quantity (in a desired spot shape, or a desired stripe shape).

Specifically, the postprocessing unit 50 can select one of (1) discharging in an entire area of the region where an image can be formed of the roll paper Md (recording medium), (2) discharging in an area where the image is formed of the roll paper Md, (3) discharging only in an area of the part where the image is formed (dot discharged part) of the roll paper Md, and the like. Moreover, the postprocessing unit 50 can select (4) discharging an area larger than the part where the image is formed (by one or more dots from the outer edge of the part where the image is formed) of the roll paper Md (recording medium). Furthermore, the postprocessing unit 50 can discharge the postprocess liquid in "n" % of the region, which is selected to discharge the postprocess liquid (a spot shape or a stripe shape).

The value of "n" may be arbitrarily selected within a range of 5 to 50. Moreover, the value of "n" may be previously determined experimentally or by numerical calculations.

Moreover, the postprocessing unit 50 according to the present embodiment can select, as the method of discharging the postprocess liquid 50L, one of (1) discharging based on the print duty, (2) discharging based on the quantity of droplets of the postprocess liquid 50L to be discharged, and the like. Moreover, the postprocessing unit 50 may calculate the print duty or the quantity of droplets of the postprocess liquid 50L from the input information, such as print image data, and determine the method of discharging based on the calculated print duty or the like.

Accordingly, compared with the case of applying (discharging) the postprocess liquid on the whole surface of the recording medium, the image forming apparatus according to the present invention, using the postprocessing unit 50, can deposit (discharge) the postprocess liquid only in the specific part within the region where the image is formed. Then, in the image forming apparatus 100 according to the present embodiment, the time required for the postprocessing, especially the desiccation of the postprocess liquid, can be reduced. Moreover, compared with the case of applying (discharging) the postprocess liquid on the whole surface of the recording medium, in the image forming apparatus 100 according to the present embodiment, the quantity of the postprocess liquid required for the postprocess can be reduced. Furthermore, compared with the case of applying (discharging) the postprocess liquid on the whole surface of the recording medium, the quantity of the postprocess liquid can be reduced, and the cost required for the postprocess can be reduced.

Moreover, the image forming apparatus 100 according to the present embodiment can control the discharge quantity of the postprocess liquid to be discharged, such as a film thickness, a quantity of liquid, an adherence quantity, a dried adherence quantity, or the like, and can discharge the postprocess liquid of the discharge quantity, which is appropriate for the image forming and the postprocess, on the surface of the roll paper Md (recording medium).

Furthermore, the postprocessing unit 50 of the image forming apparatus 100 according to the present embodiment can control the discharge quantity of the postprocess liquid to be discharged, where the discharge quantity of the postprocess liquid can be determined based on the kind of ink (pigment) used for the formation of the image on the surface of the recording medium. Moreover, the postprocessing unit 50 according to the present embodiment can control the discharge quantity of the postprocess liquid to be discharged, where the discharge quantity of the postprocess liquid can be determined based on the kind of the recording medium. That is, since the postprocessing unit 50 according to the present embodiment can control the discharge quantity of the postprocess liquid, the quality of the formed image can be enhanced and the cost can be reduced.

The method of performing the postprocessing by the postprocessing unit 50 is not limited to the above example, and may be appropriately selected according to the kind of the postprocess liquid. Moreover, for the method of the postprocessing by the postprocessing unit 50, the above-described method of application of the preprocess liquid by the preprocessing unit 20, or the above-described method of discharging ink by the image forming unit 40 may be used. Furthermore, for the method of the postprocessing by the postprocessing unit 50, the same method as the method of discharge of ink by the image forming unit 40 is preferably used from a viewpoint of the downsizing of the apparatus and the preservation stability of the postprocess liquid. In the present embodiment, the postprocessing unit 50 discharges the postprocess liquid. But, the present invention is not limited to this. The postprocessing unit 50 may apply the postprocess liquid onto the surface of the recording medium.

In the case of using the method of discharging ink by the image forming unit 40 for the method of performing the postprocessing by the postprocessing unit 50, the drive method of the discharge head, by controlling the voltage (drive waveform) applied on the piezoelectric element 45P, can perform the pull-out, the push-out or the like. Moreover, the drive method of the discharge head 40K, by controlling the upper and the lower values of the voltage, a transition time to the upper or the lower value, or a voltage of combination of retention time of the voltage or the like (drive waveform), may control the state of deflection deformation of the vibration plate 42 by the extension or retention of the piezoelectric element 45P. Furthermore, the drive method of the discharge head, by controlling the enlargement (expansion) or reduction (shrinkage) of the volume to contain ink of the liquid chamber 40-F, can change the quantity of the postprocess liquid to be discharged. By using the above method, the desired postprocess liquid can be discharged on the roll paper Md (recording medium).

The postprocessing unit 50 according to the present embodiment, in the case of discharging the postprocess liquid, preferably includes an appropriate amount of water-soluble organic solvent (wetting agent), used in the method of discharging ink by the image forming unit 40. Moreover, the postprocessing unit 50 preferably discharges the postprocess liquid, a dried adherence quantity of which is in the range of 0.5 $g/m^2$ to 10 $g/m^2$. The postprocessing unit 50 more preferably discharges the postprocess liquid, a dried adherence quantity of which is in the range of 2 $g/m^2$ to 8 $g/m^2$.

When the dried adherence quantity of the postprocess liquid is less than 0.5 $g/m^2$, the quality of the image (density of image, chromaticity, glossiness and fixing) may be degraded. Moreover, when the dried adherence quantity of the postprocess liquid is greater than 10 $g/m^2$, the desiccation characteristic of the protection layer (postprocess liquid) may be degraded, i.e. the desiccation may require a long time. Furthermore, when the dried adherence quantity of the postprocess liquid is greater than 10 $g/m^2$, the enhancement effect of the image quality by the postprocess may be saturated, and may be economically disadvantaged.

The postprocessing unit 50 according to the present embodiment can use, as the postprocess liquid, process liquid including ingredients which can form a transmissive protection layer on the roll paper Md (recording medium). The process liquid including ingredients which can form a transmissive protection layer are, for example, process liquid including water dispersible resin (resin), water-soluble organic agent (wetting agent), penetrating agent, surfactant agent, water, and/or other ingredients as necessary. Moreover, the postprocess liquid may be a resin composition including ingredients, which are polymerized by ultraviolet irradiation and/or thermoplastic resin. Furthermore, the postprocess liquid is preferably a thermoplastic resin emulsion for enhancing the glossiness and the fixing. Accordingly, the postprocessing unit 50 can increase the glossiness of the surface of the roll paper Md on which the image is formed, or can protect the surface of the roll paper Md with a resin layer, according to the method of discharge (application).

The water dispersible resin (resin) is preferably, for example, acrylic resin, styrene-acrylic resin, urethane resin, acrylic-silicone resin, fluorine resin, or the like. From these water dispersible resins, the same resin as the water dispersible resin used in the method of discharging ink by the image forming unit 40 may be arbitrarily selected and used. Moreover, a contained amount of the water dispersible resin in the protection layer is preferably within a range of 1 mass % to 50 mass % in solid content. Furthermore, in the case of using the method of discharging ink by the image forming unit 40, the contained amount of the water dispersible resin in the protection layer is preferably within a range of 1 mass % to 30 mass %.

When the contained amount of resin exceeds 50 mass %, high viscosity of the postprocess liquid may be required. Moreover, when the contained amount of resin is less than 1 mass %, a large amount of energy may be required for evaporating water in the postprocess liquid.

A mean particle diameter (D50) of the water dispersible resin in the postprocess liquid relates to the viscosity of the postprocess liquid. When the compositions are the same, the smaller the particle diameter is, the higher the viscosity of the postprocess liquid is. Accordingly, in order to prevent an excessively high viscosity on the postprocess, the mean particle diameter (D50) of the water dispersible resin is preferably greater than or equal to 50 nm.

Moreover, when the mean particle diameter of the water dispersible resin in the postprocess liquid is several tens of micrometers, the particle diameter is larger than the nozzle diameter of the discharge head, which discharges the postprocess liquid, i.e. the diameter of the discharge port 40-N in FIG. 5A. This is not preferable. Moreover, even when the mean particle diameter of the water dispersible resin in the postprocess liquid is less than the nozzle diameter, if there are particles with large diameters, the discharging performance of the discharge head may be degraded. Accordingly, the mean particle diameter (D50) of the postprocess liquid (water dispersible resin) is preferably less than or equal to 200 nm, and more preferably less than or equal to 150 nm.

In the case of using the water-soluble organic agent (wetting agent), the contained amount of the water-soluble organic agent in the postprocess liquid is not limited. The contained amount of the water-soluble organic agent may be within a range of 10 to 80 mass %. The contained amount of the water-soluble organic agent is preferably within a range of 15 to 60 mass %. The water-soluble organic agent (wetting agent) is, for example, 1,3-butadiene, glycerin. When the contained amount of the water soluble organic agent is larger than 80 mass %, the desiccation of the recording medium after the postprocess may require a long time. Moreover, when the contained amount of the water soluble organic agent is less than 10 mass %, the composition of the postprocess liquid may change by mixing with the preprocess liquid.

The penetrating agent and the surfactant agent are not constrained. The penetrating agent is, for example, 2-ethyl-1,3-hexanediol. The surfactant agent is, for example, perfluoroalkylpolyethylene oxide adduct. For the penetrating agent and the surfactant agent on the postprocess, the penetrating agent or the surfactant agent included in the preprocess liquid used by the preprocessing unit 20 or in the ink used by the image forming unit 40 may be arbitrarily selected.

The postprocess liquid may further include other ingredients. The postprocess liquid may further include, for example, wax, pH adjuster, antimicrobial agent, surface modifier, antifoam agent, or the like.

The wax is, for example, polyethylene wax. The pH adjuster is, for example, 2-amino-2-ethyl-1,3-propanediol. The antimicrobial agent is, for example, active ingredient 1,2-benzothiazole-3-one. The surface modifier is, for example, a mixture of polyether-modified polydimethylsiloxane and polyether (polyether-modified polydimethylsiloxane). The antifoam agent is, for example, 2,4,7,9-tetramethyl-4,7-decanediol.

Export Unit

The export unit 60 exports (discharges) the recording medium, on which an image is formed.

As shown in FIG. 1, the export unit 60 according to the present embodiment includes a storage unit 61 and plural transportation rollers 62. The export unit 60, using the transportation rollers 62 or the like, winds the roll paper Md, on which an image is formed, around a storage roll of the storage unit 61, and stores it.

While the roll paper Md is being wound around the storage roll of the storage unit 61, when pressure acting on the roll paper Md is high, a desiccation unit may be provided just before the wind-up, in order to prevent images from transferring to a back side of the roll paper Md.

Control Unit

The control unit 70 controls the operation of the image forming apparatus 100. The control unit 70 sends operating instructions to each element of the image forming apparatus 100, and controls the operations. Moreover, in the present embodiment, the control unit 70 determines the kind of ink with which to form an image. The control unit 70, for example, based on input information which a user inputs to the image forming apparatus 100, can determine the kind of the ink with which to form the image.

With reference to FIGS. 7A to 10, the control unit 70 according to the present embodiment will be explained.

In the image forming apparatus 100, production printing may be employed as the printing system. The production printing here is a manufacturing system, which can perform printing (forming image or printing characters) for a large amount of printed matter (image formed media or character printed matter) by performing efficiently job management and printing data management. Specifically, the image forming apparatus 100 according to the present embodiment performs a RIP (Raster Image Processor) process, which controls an operation of printing bitmap data or the like, and the printing process based on the bitmap data controlled by the RIP process at a different apparatus (unit).

Moreover, the image forming apparatus 100 (control unit 70) according to the present embodiment configures a system of workflow for managing from creating printing data to distributing printed matter. That is, the image forming apparatus 100 (control unit 70) according to the present embodiment can speed up printing by separating the apparatuses performing the RIP (Raster Image Processor) process and the printing process, which require process time.

Figure 7A:
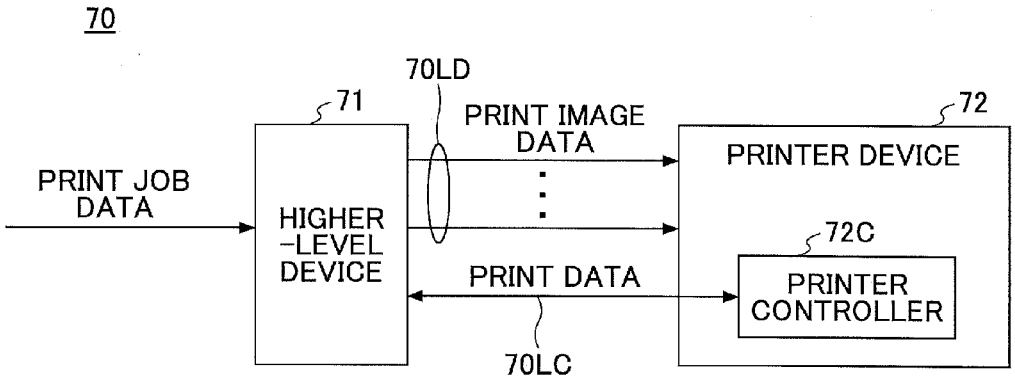
FIGS. 7A and 7B are diagrams schematically illustrating examples of a control unit in the image forming apparatus according to the present embodiment.

As shown in FIG. 7A, the control unit 70 in the image forming apparatus 100 according to the present embodiment includes a higher-level device (Digital Front End (DFE)) 71, which performs the RIP process or the like, and a printer device 72, which performs the printing process or the like. The higher-level device and the printer device 72 are connected via plural data lines 70LD and a control line 70LC.

In the following, the higher-level device 71 and the printer device 72 will be specifically explained.

Higher-Level Device

The higher-level device 71 of the control unit 70 according to the present embodiment performs the RIP process based on print job data (job data or print data) output from a host apparatus (not shown). That is, the higher-level device 71 creates bitmap data, which will be denoted "print image data" in the following, corresponding to each color, based on the print job data. The print job data according to the present embodiment further include data relating to the discharge of the postprocess liquid discharged by the postprocessing unit 50, which will be denoted "image data related to the postprocess" in the following.

Moreover, the higher-level device 71 according to the present embodiment creates data for controlling the print operation, which will be denoted "control data" in the following, based on the print job data and information on the host apparatus. The control data here include data related to the print condition (print form, print type, information on feeding or ejecting paper, order of sides for print, size of paper for print, data size of print image data, resolution, information on kind of paper, gray level, color information, number of pages for printing, or the like). Moreover, the control data according to the present embodiment further include data related to the discharge of the postprocess liquid discharged by the postprocessing unit 50, which will be denoted "control data related to the postprocess" in the following.

Figure 7B:
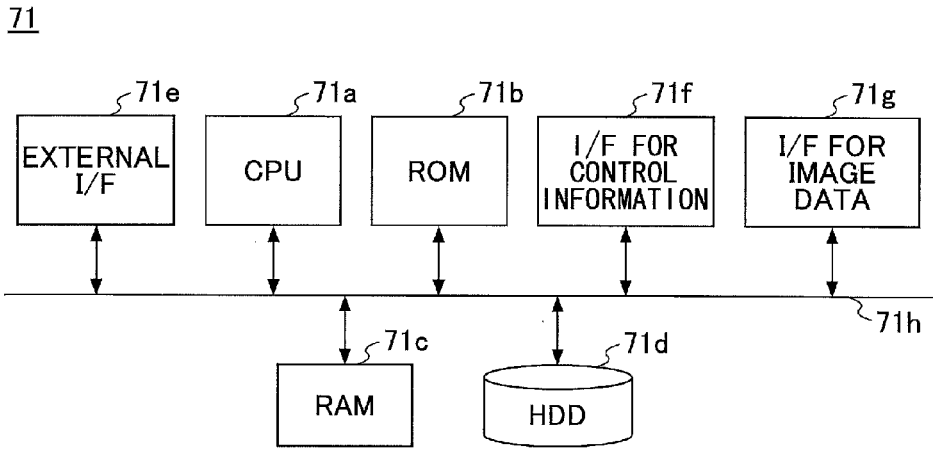

As shown in FIG. 7B, the higher-level device 71 according to the present embodiment includes a CPU (Central Processing Unit) 71*a*, a ROM (Read Only Memory) 71*b*, a RAM (Random Access Memory) 71*c* and a HDD (Hard Disk Drive) 71*d*. Moreover, the higher-level device 71 further includes an external I/F 71*e*, an I/F for control information 71*f* and an I/F for image data 71*g*. The higher-level device 71 further includes a bus 71*h*, which connects the CPU 71*a* or the like. That is, the higher-level device 71 has a configuration in which the CPU 71*a* or the like is connected via the bus 71*h* in a transceivable way.

The CPU 71*a* controls the operation of the entire higher-level device 71. The CPU 71*a* controls the operation of the higher-level device 71 by using a control program or the like stored in the ROM 71*b* and/or the HDD 71*d*.

The ROM 71*b*, the RAM 71*c* and the HDD 71*d* store data or the like. In the ROM 71*b* and/or the HDD 71*d*, the control program for controlling the CPU 71*a* is stored in advance. The RAM 71*c* is used as a work memory for the CPU 71*a*.

The external I/F 71*e* controls communication (transmission and receipt) to the outside of the image forming apparatus 100, such as the host apparatus. The external I/F 71*e* can control, for example, communications via the TCP/IP (Transmission Control Protocol/Internet Protocol).

The I/F for control information 71*f* controls communication (transmission and receipt) of control data. For the I/F for control information 71*f*, for example, the PCI Express (Peripheral Component Interconnect Bus Express) may be used.

The I/F for image data 71*g* controls communication (transmission and receipt) of print image data. For the I/F for image data 71*g*, for example, the PCI Express may be used. The I/F for image data according to the present embodiment has plural channels corresponding to colors of the print image data, which will be described later.

The higher-level device 71 of the control unit 70 according to the present embodiment receives the print job data sent from the host apparatus at the external I/F 71*e*, and stores the data in the HDD 71*d* using the CPU 71*a*. Moreover, the higher-level device 71 reads out the print job data from the HDD 71*d* using the CPU 71*a*. Furthermore, the higher-level device 71, using the CPU 71*a*, based on the read-out print job data, creates bitmap data of respective colors (yellow (Y), cyan (C), magenta (M) and black (K)), and stores the created bitmap data of respective colors in the RAM 71*c*. The higher-level device 71 (CPU 71*a*), as the RIP process, for example, may render the PDL (Page Description Language) to create the bitmap data of respective colors, and write them in the RAM 71*c*.

Next, the higher-level device 71 compresses and encodes the bitmap data of respective colors, written in the RAM 71*c*, and temporarily stores them in the HDD 71*d*.

Afterward, when a print operation starts in the printer device 72, the higher-level device 71 (CPU 71*a*) reads out the encoded bitmap data of respective colors from the HDD 71*d*, decodes the bitmap data, and writes the decoded bitmap data of respective colors in the RAM 71*c*. Next, the higher-level device 71 reads out the bitmap data of respective colors from the RAM 71*c*, and outputs them as print image data of respective colors to the printer device 72 (printer engine 72E, which will be described later) via respective channels of the I/F for image data 71*g*. The higher-level device 71 may output the print image data to the printer device 72 via the data lines 70LD (70LD-Y, 70LD-C, 70LD-M and 70LD-K), as shown in FIG. 7A as the respective channels of the I/F for image data 71*g*.

Moreover, the higher-level device 71 according to the present embodiment, in response to the proceedings of the print operation or the like, using the CPU 71*a*, transmits/receives the control data to/from the printer device 72 (printer controller 72C, which will be described later) via the I/F for control information 71*f* (control line 70LC).

Furthermore, the higher-level device 71 according to the present embodiment, when the postprocess starts at the printer device 72 (postprocessing unit 50 in FIG. 1), using the CPU 71*a*, reads out the encoded image data related to the postprocess from the HDD 71*d*, and outputs them to the printer device 72 (printer engine 72E) via the data line 70LD-P (See FIG. 8), in the same way as the above bitmap data.

Printer Device

The printer device 72 of the control unit 70 according to the present embodiment controls the operation of forming an image on a recording medium, based on the print image data and control data input from the higher-level device 71. The printer device 72 according to the present embodiment includes the printer controller 72C and the printer engine 72E.

The printer controller 72C controls an operation of the printer engine 72E, which will be described later. The printer controller 72C transmits/receives control data or the like to/from the higher-level device 71 via the control line 70LC. Moreover, the printer controller 72C transmits/receives the control data or the like to/from the printer engine 72E via the control line 72LC. According to the above configuration, the printer controller 72C writes various print conditions or the like included in the control data into a register or the like in a print control unit 72Cc, and can store the print conditions. Moreover, the printer controller 72C controls the printer engine 72E based on the control data, and can execute a print processing following the print job data (control data).

Figure 8:
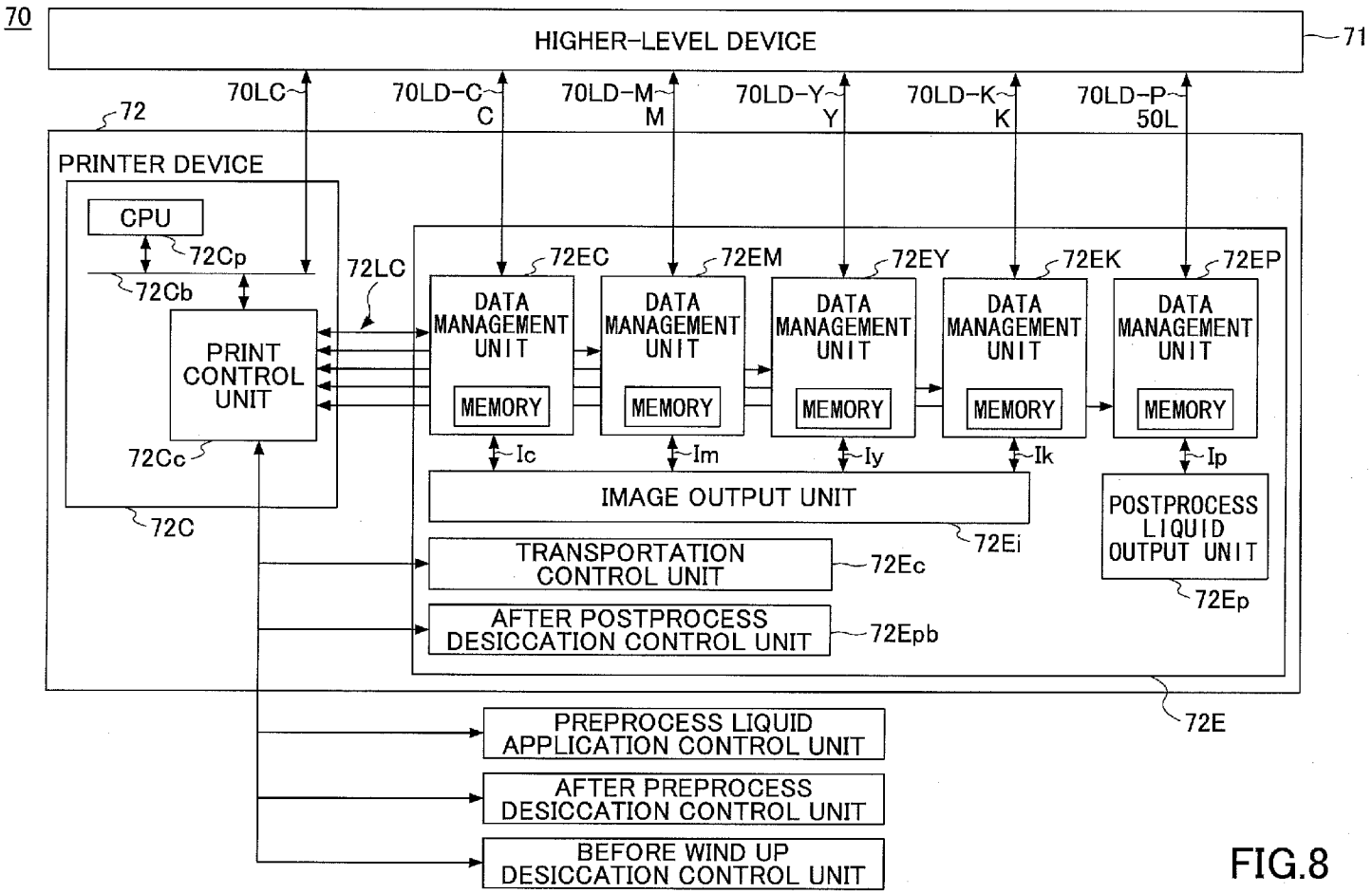
FIG. 8 is a functional block diagram illustrating an example of a function of the control unit in the image forming apparatus according to the present embodiment.

As shown in FIG. 8, the printer controller 72C according to the present embodiment includes a CPU 72Cp and the print control unit 72Cc. Moreover, the printer controller 72C connects the CPU 72Cp and the print control unit 72Cc via a bus 72Cb in a transceivable way. The bus 72Cb here is connected to the control line 70LC via a communication I/F, which is not shown.

The CPU 72Cp controls the operation of the entire printer device 72 using a control program stored in a ROM (not shown). The print control unit 72Cc transmits/receives a command or status information to/from the printer engine 72E, based on the control data transmitted from the higher-level device 71. Accordingly, the print control unit 72Cc can control the operation of the printer engine 72E.

The printer engine 72E controls an operation of forming an image in the recording medium based on the print image data input from the higher-level device 71 and on the control data input from the printer controller 72C. Moreover, the printer engine 72E controls an operation of the postprocess based on the print image data input from the higher-level device 71 (image data related to the postprocess) and on the control data input from the printer controller 72C (control data related to the postprocess).

As shown in FIG. 8, to the printer engine 72E, the plural data lines 70LD (70LD-Y, 70LD-C, 70LD-M, 70LD-K and 70LD-P) are connected. The printer engine 72E receives the print image data from the higher-level device 71 via the plural data lines 70LD-C or the like. Accordingly, the printer engine 72E can perform the print operation for respective colors and the postprocess of the postprocess liquid, based on the received print image data.

The printer engine 72E according to the present embodiment includes plural data management units 72EC, 72EM, 72EY, 72EK and 72EP. Moreover, the printer engine 72E includes an image output unit 72Ei, to which the print image data or the like are input from the data management unit 72EC or the like, and a transportation control unit 72Ec, which controls transportation of a recording medium. Furthermore, the printer engine 72E includes a postprocess liquid output unit 72Ep, to which the image data related to postprocess is input from the data management unit 72EP, and an after postprocess desiccation control unit 72Epb, which controls the operation of the desiccation unit 30 (See FIG. 1).

The printer engine 72E may further include a preprocess liquid application control unit, an after preprocess desiccation control unit, a before wind-up desiccation control unit, or the like.

Figure 9:
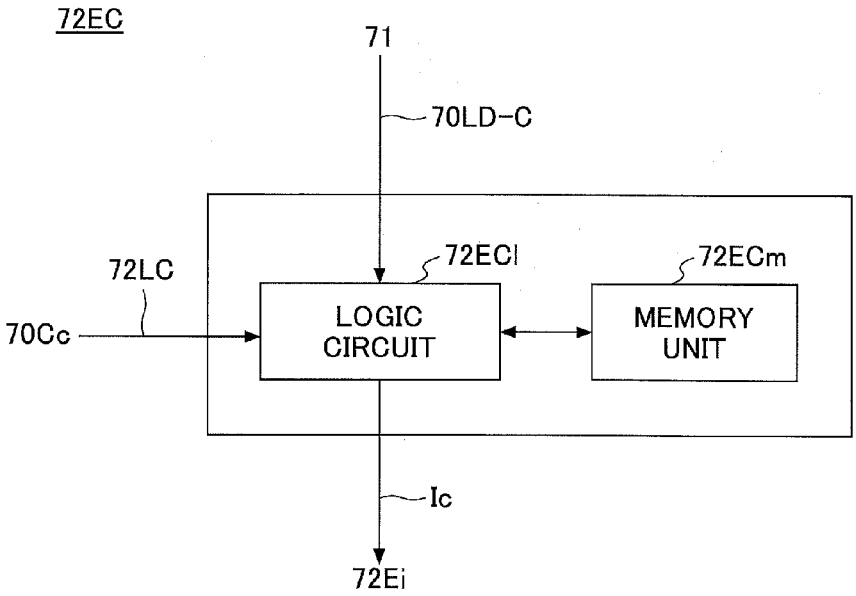
FIG. 9 is a functional block diagram illustrating an example of a data management unit of the control unit in the image forming apparatus according to the present embodiment.

With reference to FIG. 9, a configuration of the data management unit 72EC will be explained. Meanwhile, configuration of the other data management units 72EM, 72EY, 72EK and 72EP are the same as the configuration of the data management unit 72EC, and an explanation will be omitted.

As shown in FIG. 9, the data management unit 72EC includes a logic circuit 72EC1 and a memory unit 72ECm. The data management unit 72EC (logic circuit 72EC1) is connected to the higher-level device 71 via the data line 70LD-C. Moreover, the data management unit 72EC (logic circuit 72EC1) is connected to the printer controller 72C (print control unit 72Cc) via the control line 72LC.

The logic circuit 72EC1 according to the present embodiment stores the print image data output from the higher-level device 71 into the memory 72ECm, based on a control signal output from the printer controller 72C (print control unit 72Cc). Moreover, the logic circuit 72EC1 reads out print image data Ic (See FIG. 8) corresponding to cyan (C) from the memory 72ECm, based on the control signal output from the printer controller 72C (print control unit 72Cc), and outputs them to the image output unit 72Ei. Meanwhile, the logic circuit 72ECp (data management unit 72EP) outputs the image data related to postprocess Ip (See FIG. 8) to the postprocess liquid output unit 72Ep.

The memory unit 72ECm may have a capacity which can store print image data of at least three pages. The print image data of three pages are, for example, print image data corresponding to a page which is forwarding (receiving) from the higher-level device 71, print image data corresponding to a page which is being output to the image output unit 72Ei, and print image data corresponding to the next page.

In the data management unit 72EC, a logic circuit of hardware including a combination of logic circuitries or the like may be used. Accordingly, the data management unit 72EC can realize a faster process. Moreover, the data management unit 72EC may perform, for example, logic determination for the control signal including a bit array using the logic circuit 72EC1, and determine a process to execute.

Figure 10:
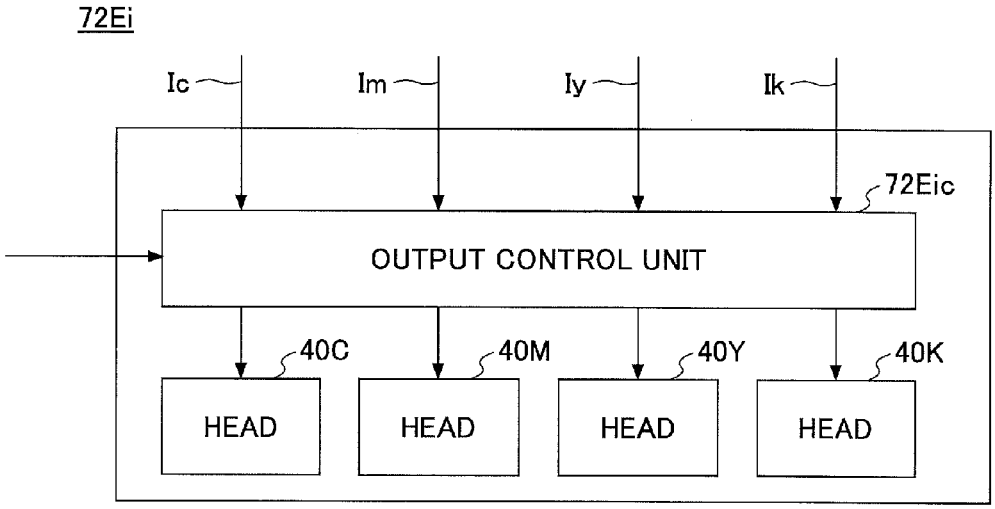
FIG. 10 is a functional block diagram illustrating an example of an image output unit of the control unit in the image forming apparatus according to the present embodiment.

With reference to FIG. 10, a configuration of the image output unit 72Ei will be described. Meanwhile, a configuration of the postprocess liquid output unit 72Ep is essentially the same as the configuration of the image output unit 72Ei, and an explanation will be omitted.

As shown in FIG. 10, the image output unit 72Ei includes an output control unit 72Eic. The output control unit 72Eic outputs print image data corresponding to respective colors to the discharge heads 40C, 40M, 40Y and 40K (See FIG. 4A) corresponding to the respective colors. Accordingly, the output control unit 72Eic can control the operation of the discharge head 40C or the like, based on the print image data.

Specifically, the output control unit 72Eic controls the plural discharge heads 40C or the like individually. Moreover, the output control unit 72Eic, using the input print image data (for example, Ic in FIG. 10), may control the plural discharge heads 40C or the like simultaneously. Furthermore, the output control unit 72Eic, based on a control signal input from a control device, which is not shown, may control the discharge head 40C or the like. The output control unit 72Eic may control the discharge head 40C or the like, for example, based on an input operation by the user.

The printer device 72 according to the present embodiment, as described above, inputs the print image data output from the higher-level device 71 to the plural discharge heads 40C or the like, using the data management unit 72EC or the like and the output control unit 72Eic. Then, the printer device 72 can control the print image data of respective colors independently of each other. Moreover, the printer device 72, can change the configuration of the printer engine 72E easily according to the number of colors of the print image data (C, M, Y and K, only K, or the like) or the number of the discharge heads. That is, the image forming apparatus 100 (printer device 72) according to the present embodiment has an advantageous effect in downsizing of the apparatus or in lowering the cost, by installing only the necessary data management unit 72EC or the like and the discharge heads 40C or the like.

The image forming apparatus 100 (printer device 72) according to the present embodiment can be provided with all the data management units 72EC or the like in the printer engine 72E in the case of performing, for example, full color printing with four colors, i.e. C, M, Y and K. Accordingly, the image forming apparatus 100 (printer device 72) can connect respective outputs from the data management unit 72EC or the like to the respective discharge head 40C or the like.

Moreover, the image forming apparatus 100 (printer device 72) may be provided with only one data management unit 72EK and a discharge head 40K in the case of performing, for example, printing with one color K, giving priority to the apparatus cost. Accordingly, the image forming apparatus 100 (printer device 72) can connect output from the data management unit 72EK to the discharge head 40K by using the output control unit 72Eic.

Furthermore, the image forming apparatus 100 (printer device 72) may be provided with one data management unit 72EK and four discharge heads in the case of performing, for example, printing with one color K, giving priority to the printing speed. Accordingly, the image forming apparatus 100 (printer device 72) can connect output from the data management unit 72EK to the respective discharge heads by using the output control unit 72Eic. In this case, the image forming apparatus 100 (printer device 72) can print the same color (K) overlapping (superimposing) by plural times, and can realize a print process (image forming process), which is four times faster than the case of forming an image by one discharge head.

Image Forming System

In the following, an example of an image forming system according to the present embodiment will be described.

The image forming system according to the present embodiment includes an import device which imports (provides) a roll paper Md (recording medium), a preprocessing device which performs preprocessing for the roll paper Md, a preprocess liquid desiccation device which desiccates the preprocessed roll paper Md, and an image forming device which forms an image on the roll paper Md. Moreover, the image forming system according to the present embodiment includes a postprocessing device which performs postprocessing for the roll paper Md on which the image being formed, a postprocess liquid desiccation device which desiccates the postprocessed roll paper Md, and an export device which exports (collects) the roll paper Md. Furthermore, the image forming system according to the present embodiment further includes a control device which controls operations of the entire image forming system.

The import device is provided with the configuration and the function of the import unit 10 of the image forming apparatus 100 as described above. The preprocessing device is provided with the configuration and the function of the preprocessing unit 20 of the image forming apparatus 100 as described above. The preprocess liquid desiccation device is provided with the configuration and the function of the preprocess liquid desiccation unit 31 of the image forming apparatus 100 as described above. The image forming device is provided with the configuration and the function of the image forming unit 40 of the image forming apparatus 100 as described above. The postprocessing device is provided with the configuration and the function of the postprocessing unit 50 of the image forming apparatus 100 as described above. The postprocess liquid desiccation device is provided with the configuration and the function of the postprocess desiccation unit 32 of the image forming apparatus 100 as described above. The export device is provided with the configuration and the function of the export unit 60 of the image forming apparatus as described above. The control device is provided with the configuration and the function of the control unit 70 of the image forming apparatus 100 as described above.

The image forming system according to the present embodiment connects the import device, the preprocessing device, the preprocess liquid desiccation device, the image formation device, the postprocessing device, the postprocess liquid desiccation device, the export device and the control device to each other by wired and/or wireless methods. Moreover, the image forming apparatus controls operations of the import device, the preprocessing device, the preprocess liquid desiccation device, the image formation device, the postprocessing device, the postprocess liquid desiccation device and the export device, by using the control device. Meanwhile, the operations of the import device or the like are the same as those of the image forming apparatus 100, and an explanation will be omitted.

As described above, an example of the image forming system obtains the same effect as the image forming apparatus 100 according to the present embodiment.

Example

The present invention will be described by using the image forming apparatus and a print apparatus according to the Example.

First Example

The present invention will be explained by using the image forming apparatus 100E according to the first example.

(Configuration of Image Forming Apparatus), (Import Unit), (Preprocessing Unit), (Desiccation Unit), (Image Forming Unit), (Postprocessing Unit), (Export Unit) and (Control Unit)

FIGS. 1 to 10 illustrate a configuration or the like of the image forming apparatus 100E according to the present example. As shown in FIGS. 1 to 10, the configuration or the like of the image forming apparatus 100E according to the present example is essentially the same as the configuration or the like of the image forming apparatus 100 according to the embodiment as described above, and an explanation will be omitted.

(Operation of Forming Image)

Figure 11:
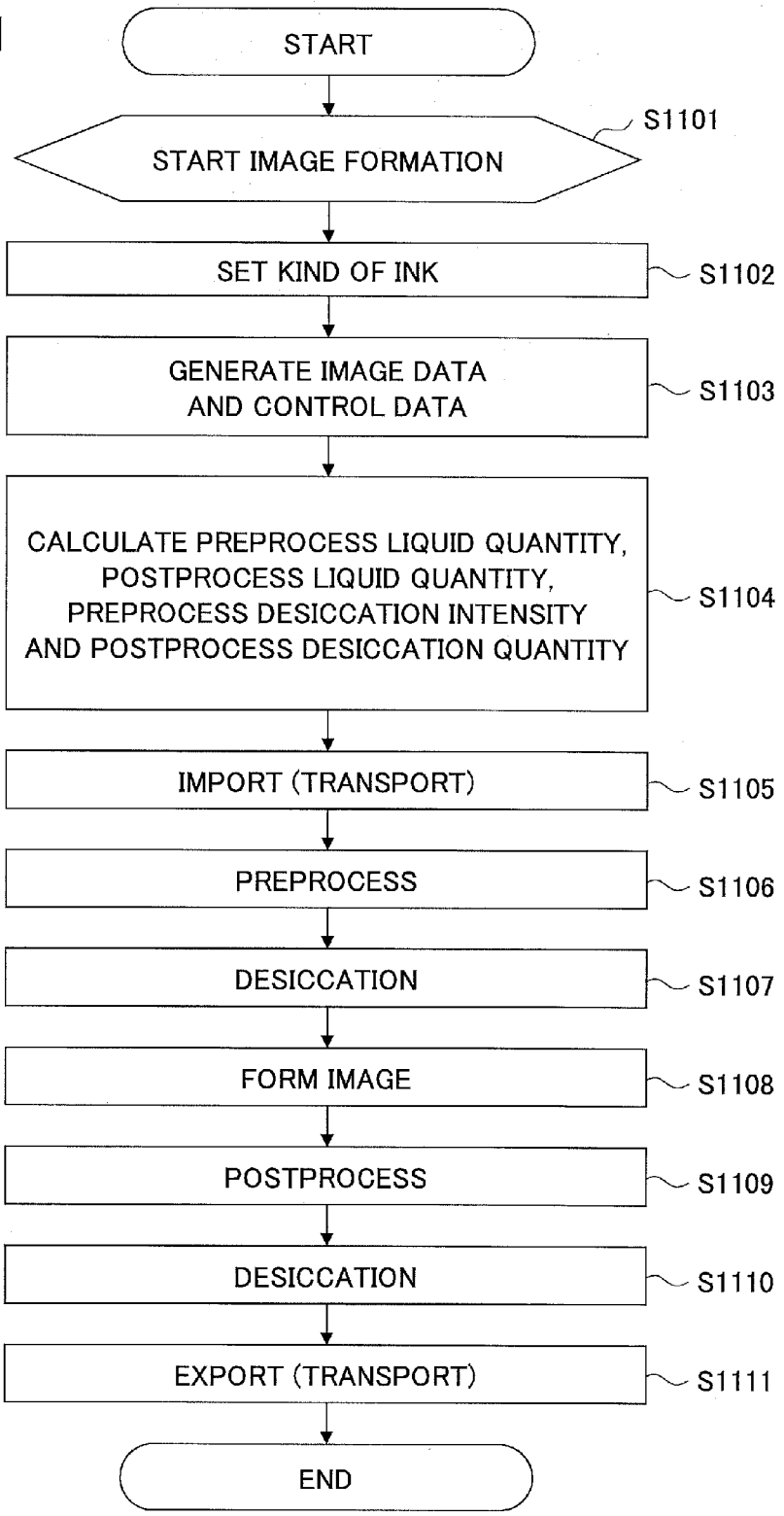
FIG. 11 is a flowchart illustrating an example of an operation of an image forming apparatus according to a first Example.
Figure 12:
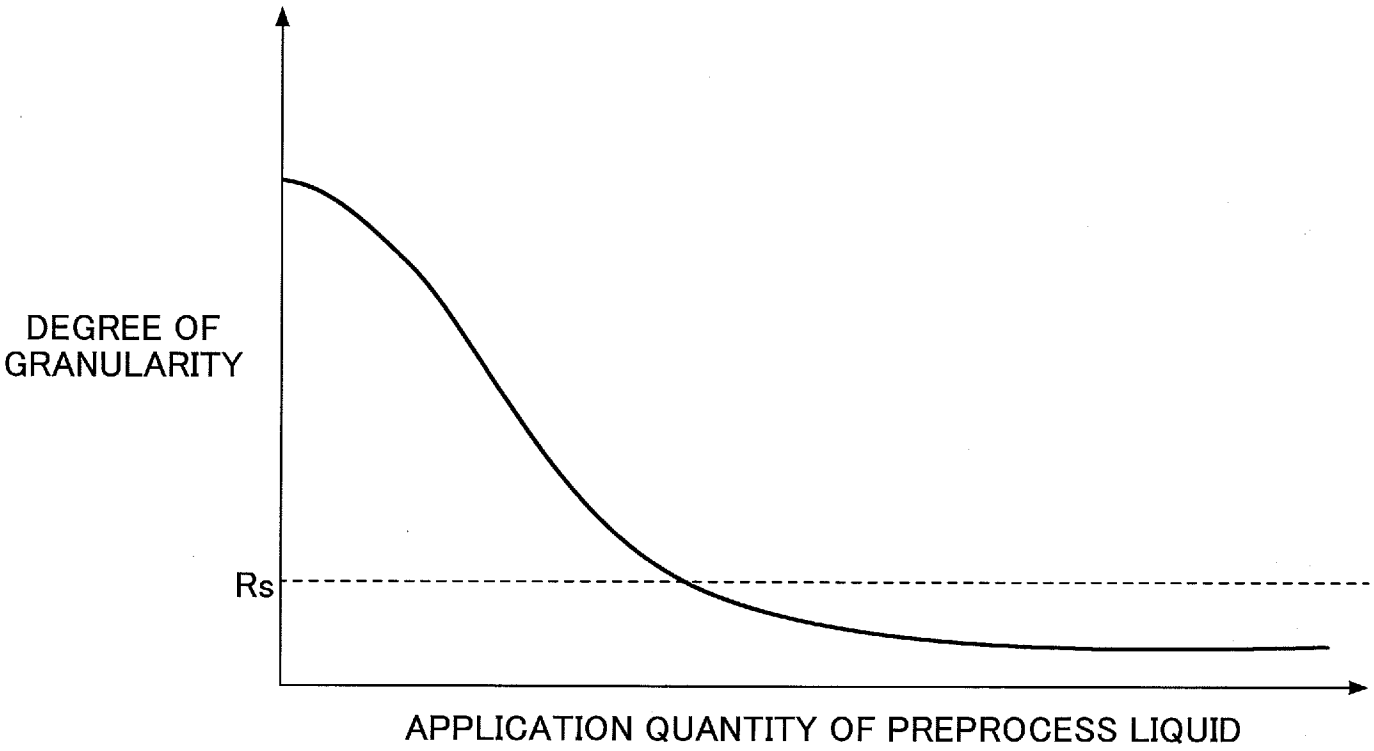
FIG. 12 is an explanatory diagram illustrating an example of a relationship between an application quantity and a degree of granularity of preprocess liquid in the image forming apparatus according to the first Example.

With reference to FIGS. 11 and 12, an operation of forming an image by the image forming apparatus 100E according to the present example will be described. FIG. 11 is a flowchart illustrating an example of the operation of the image forming apparatus 100E according to the first example. FIG. 12 is an explanatory diagram illustrating a relationship between an application quantity and a degree of granularity of preprocess liquid in the image forming apparatus 100E according to the first example.

As shown in FIG. 11, the image forming apparatus 100E according to the present example starts forming an image based on print job data or the like input from the outside of the image forming apparatus 100E (step S1101). Moreover, the image forming apparatus 100E stores the input print job data or the like in the HDD 71*d* or the like of the higher-level device 71. After the image formation starts, the process of the image forming apparatus 100E proceeds to step S1102.

Next, the image forming apparatus 100E determines the kind of ink, which is to form the image, or the like, by using the control unit 70, and stores the determined kind of ink or the like in the HDD 71*d* or the like of the higher-level device 71.

The control unit 70 stores the information on ink (physical property of ink, such as viscosity, surface tension, or density) as the kind of ink. Moreover, the control unit 70 may store the kind of ink or the like by associating with items of ink, which are stored in advance in the HDD 71*d* or the like of the higher-level device 71 as the kind of ink or the like. Accordingly, the control unit 70 can read out the kind of ink or the like using the associated item of ink in later operations. Meanwhile, in the image forming apparatus 100E, the items of ink or the like may be stored in advance by the user in the HDD 71*d* or the like of the higher-level device 71.

The process of the image forming apparatus 100E proceeds to step S1103.

Next, the image forming apparatus 100E generates print image data, control data and the like using the higher-level device 71 of the control unit 70 (step S1103).

Specifically, the higher-level device 71 of the control unit 70 generates the print image data, the control data and the like based on the print job data or the like stored in the HDD 71*d* or the like and the kind of ink or the like. Moreover, the higher-level device 71 of the control unit 70 generates image data related to postprocess (at step S1109, which will be described later) or the like.

The process of the image forming apparatus 100E proceeds to step S1104.

The image forming apparatus 100E calculates a quantity of the preprocess liquid (quantity of application) and a quantity of the postprocess liquid (quantity of discharge) using the control unit 70. Moreover, the image forming apparatus 100E calculates desiccation intensity (preprocess liquid desiccation intensity and postprocess liquid desiccation intensity) using the control unit 70.

Specifically, the control unit 70 calculates the application quantity of the preprocess liquid of the preprocessing unit 20 and the discharge quantity of the postprocess liquid of the postprocessing unit 50 based on the kind of ink or the like. The control unit 70 can increase the application quantity of the preprocess liquid when an adhesion quantity of ink per unit area discharged on the recording medium (roll paper Md) is large. Moreover, the control unit 70 can decrease the application quantity of the preprocess liquid when the adhesion quantity of ink per unit area discharged on the recording medium is small. Furthermore, the control unit 70 can increase the discharge quantity of the postprocess liquid when the application quantity of the preprocess liquid is increased. Moreover the control unit 70 can decrease the discharge quantity of the postprocess liquid when the application quantity of the preprocess liquid is decreased.

That is, the control unit 70 can calculate the quantity of liquid (application quantity) of the preprocess liquid and the quantity of liquid (discharge quantity) of the postprocess liquid based on the kind of ink which forms an image, or the like. Moreover, the calculation of the discharge quantity of the postprocess liquid 50L by the control unit 70 includes calculating the application quantity of the preprocess liquid based on the kind of ink and calculating the discharge quantity of the postprocess liquid based on the calculated application quantity of the preprocess liquid. Accordingly, even when the rub resistance of the image to be formed is degraded, the image forming apparatus 100E can enhance the rub resistance of ink on the recording medium, on which the image is formed, by increasing the discharge quantity of the postprocess liquid at step S1109 (postprocess, which will be described later). When the image forming apparatus 100E increases the application quantity of the preprocess liquid at step S1106 (preprocess, which will be described later), for example, the rub resistance of the image, which is formed afterward, is degraded.

Increasing the application quantity of the preprocess liquid by the control unit 70 may be, for example, increasing the adhesion quantity of the preprocess liquid on the recording medium to more than 1.5 g/m$^2$. Moreover, increasing the discharge quantity of the postprocess liquid may be, for example, increasing the adhesion quantity of the postprocess liquid on the recording medium to more than 1.2 g/m$^2$. On the other hand, decreasing the application quantity of the preprocess liquid and decreasing the discharge quantity of the postprocess liquid may be, for example, decreasing the adhesion quantities to less than 1.5 g/m$^2$ and 1.2 g/m$^2$, respectively. Moreover, decreasing the application quantity of the preprocess liquid and the discharge quantity of the postprocess liquid may include not applying the preprocess liquid and not discharging the postprocess liquid, respectively. Furthermore, the control unit 70 may arbitrarily change the application quantity of the preprocess liquid and the discharge quantity of the postprocess liquid according to the physical property the recording medium.

Moreover, the control unit 70 (image forming apparatus 100E) calculates the desiccation intensity (the preprocess liquid desiccation intensity and the postprocess liquid desiccation intensity) based on the kind of ink or the like. The control unit 70 (image forming apparatus 100E) may calculate the desiccation intensity further using the adhesion quantity per unit area discharged on the recording medium, a drying characteristic of ink or the like, and the liquid quantity (application quantity) of the preprocess liquid and the liquid quantity (discharge quantity) of the postprocess liquid. When the adhesion quantity of ink per unit area discharged on the recording medium is large, for example, the application quantity of the preprocess liquid by the preprocessing unit 20 becomes large, and the control unit 70 increases the desiccation intensity of the preprocess liquid desiccation unit 31, to desiccate surface of the recording medium sufficiently. Moreover, when the adhesion quantity per unit area discharged on the recording medium is small, the application quantity of the preprocess liquid becomes small, and the preprocess liquid desiccation unit 31 decreases the desiccation intensity, to suppress the shrinkage of paper due to the excess of desiccation of the recording medium.

In the postprocessing unit 50, when the adhesion quantity per unit area is large, an absorption quantity (quantity of absorption of liquid) of the recording medium increases, and the application quantity of the postprocess liquid increases so as to enhance the rub resistance (abrasion resistance) sufficiently. Also in this case, since the desiccation of the recording medium requires a long time when the application quantity of the postprocess liquid increases, the postprocess liquid desiccation unit 32 increases the desiccation intensity, to desiccate the recording medium sufficiently. On the other hand, when the adhesion quantity per unit area is small, the absorption quantity (quantity of absorption of liquid) of the recording medium decreases, and the application quantity of the postprocess liquid required for obtaining the rub resistance (abrasion resistance) becomes small. Then, the postprocess liquid desiccation unit 32 decreases the desiccation intensity so as to suppress the shrinkage of paper due to the excess of desiccation.

In this way, by calculating an appropriate desiccation intensity for the kind of the recording medium, a degradation of the printing quality due to insufficient desiccation and an occurrence of the shrinkage of paper due to the excess of desiccation can be suppressed.

After the calculation of the quantity of the preprocess liquid, the quantity of the postprocess liquid and the desiccation intensity, the process of the image forming apparatus 100E proceeds to step S1105. Meanwhile, the image forming apparatus 100E may have a configuration where the quantity of the preprocess liquid and the quantity of the postprocess liquid corresponding to the kind of ink, which are stored in advance, are selected by the user or the like through an UI (user interface) or the like.

The image forming apparatus 100E imports (transports) the recording medium to the preprocessing unit 20 or the like by using the import unit 10 (See FIG. 1) (step S1105). Meanwhile, the image forming apparatus 100E may start the process at step S1105 just after the process of forming an image starts at step S1101.

After the importation starts, the process of the image forming apparatus 100E proceeds to step S1106.

The image forming apparatus 100E performs the preprocess for the recording medium as the preprocess step by using the preprocessing unit 20 (see FIG. 2) (step S1106).

Specifically, the preprocessing unit 20, based on the application quantity of the preprocess liquid calculated at step S1104, controls the nip pressure by using the pressure adjustment unit 25 (See FIG. 2), to control (change) the application quantity (film thickness or the like) of the preprocess liquid. Meanwhile, the preprocessing unit 20 may control the application quantity of the preprocess liquid 20L by changing the rotational speed of the application roller 23 (See FIG. 2).

Accordingly, the image processing apparatus 100E, by controlling the application quantity of the preprocess liquid in the preprocessing unit 20, can suppress the blurring of an image (ink), which is formed afterward. For example, as shown in FIG. 12, the image forming apparatus 100E, by increasing the application quantity of the preprocess liquid in the preprocessing unit 20, can make the degree of granularity (beading) of ink discharged when an image is formed smaller. That is, the image forming apparatus 100E, by increasing the application quantity of the preprocess liquid in the preprocessing unit 20, can make the degree of granularity (beading) of the ink used for forming the image less than or equal to the predetermined value Rs.

The predetermined beading Rs may be the beading where the ink on the recording medium is hard to blur. Moreover, the predetermined beading Rs may be determined in advance experimentally or by numerical calculations or the like.

The image forming apparatus 100E then transports the recording medium to the preprocess liquid desiccation unit 31 (See FIG. 1), and the process proceed to step S1107.

The image forming apparatus 100E desiccates the recording medium by using the preprocess liquid desiccation unit 31 (heat roller 311 or the like, shown in FIG. 3) (step S1107). The preprocess liquid desiccation unit 31 controls the desiccation intensity based on the preprocess liquid desiccation intensity calculated at step S1104. The image forming apparatus 100E then transports the recording medium to the image forming unit 40 (See FIG. 1), and the process proceeds to step S1108.

The image forming apparatus 100E forms an image on a surface of the recording medium using the image forming unit 40, based on the print image data generated at step S1103, as the image forming step (step S1108). The image forming unit 40 may form the image further using a kind of the recording medium. Moreover, the image forming unit 40, by controlling a voltage (drive voltage) applied to the piezoelectric element 45P (pressure generation unit 45, shown in FIG. 5), can control the operation of forming the image. The image forming apparatus 100E then transports the recording medium to the postprocessing unit 50 (See FIG. 1), and the process proceeds to step S1109.

The image forming apparatus 100E performs the postprocess for the recording medium by using the postprocessing unit 50, as the postprocess step (step S1109).

Specifically, the postprocessing unit 50, based on the discharge quantity calculated at step S1104 and the image data related to postprocess (step S1103) or the like, accumulates (discharges) the postprocess liquid in a specific part in the region where the image is formed on the recording medium. The postprocessing unit 50 may control the discharge quantity to be discharged on the recording medium, based on the image data related to postprocessing, by using the postprocess liquid output unit 72Ep.

The image forming apparatus 100E then transports the recording medium to the postprocess liquid desiccation unit 32 (See FIG. 1), and the process proceeds to step S1110.

The image forming apparatus 100E desiccates the recording medium, using the postprocess liquid desiccation unit 32 (step S1110). The postprocess liquid desiccation unit 32 controls the desiccation intensity, based on the postprocess liquid desiccation intensity calculated at step S1104, in the same way as the preprocess liquid desiccation unit 31. After the desiccation, the process of the image forming apparatus 100E proceeds to step S1111.

The image forming apparatus 100E transports (exports) the recording medium, by using the export unit 60 (See FIG. 1) (step S1111). The process of the image forming apparatus 100E then proceeds to END in FIG. 11, and the operation of forming the image ends.

As described above, the image forming apparatus 100E according to the first example, can obtain the same effect as in the control device of the image forming apparatus 100 according to the embodiment.

Variation

The present invention will be explained by using an image forming apparatus 200E according to a variation of the first example.

(Configuration of Image Forming Apparatus), (Import Unit), (Preprocessing Unit), (Desiccation Unit), (Image Forming Unit), (Postprocessing Unit), (Export Unit) and (Control Unit)

The configuration or the like of the image forming apparatus 200E according to the present example is essentially the same as the configuration or the like of the image forming apparatus 100E according to the first example, and a different part will be mainly explained.

In the image forming apparatus 100E according to the first example, the control unit 70 calculates the application quantity of the preprocess liquid and the discharge quantity of the postprocess liquid, based on the kind of ink.

The control unit 70 according to the present variation stores further, as the kind of ink or the like, information on ink outside the image forming apparatus 200E or input by the user or the like, such as the physical property of ink (viscosity, surface tension, density or the like). Moreover, the control unit 70 stores the input ink information in the HDD 71*d* of the higher-level device 71. Furthermore, the control unit 70 recalculates the discharge quantity of the postprocess liquid added to the calculations in the first example, based on the input ink information (kind of ink, for example). The ink information may include information on the permeability of ink on the recording medium or on the glossiness of ink forming an image on the recording medium. Meanwhile, the control unit 70 may determine the glossiness of ink based on the ink information (kind of ink), and recalculate the discharge quantity of the postprocess liquid using the result of determination.

(Operation of Forming Image)

Figure 13:
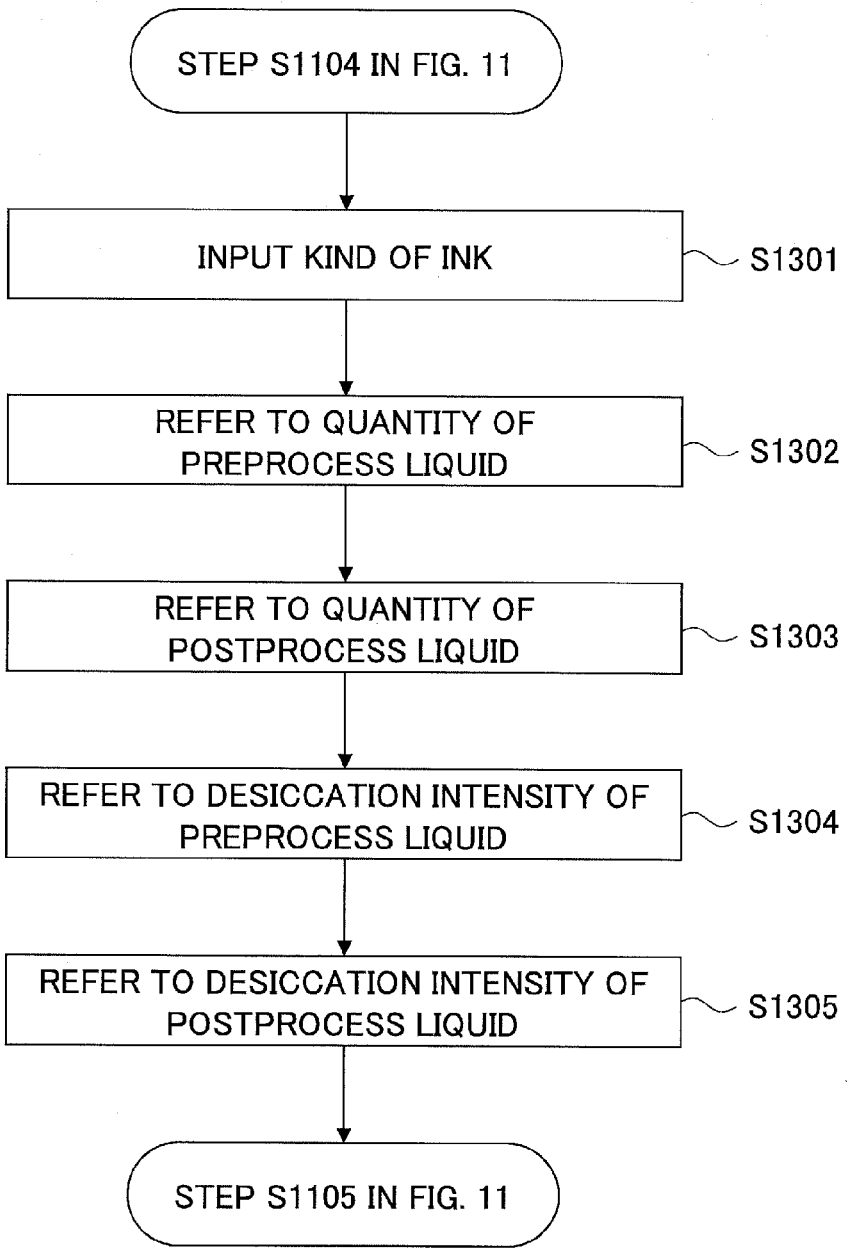
FIG. 13 is a flowchart illustrating an example of an operation of an image forming apparatus according to a variation of the first Example.

With reference to FIG. 13, the operation of forming an image by the image forming apparatus 200E according to the present variation will be explained. FIG. 13 is a flowchart illustrating an example of the operation of the image forming apparatus 200E according to the variation of the first example.

As shown in FIG. 13, the image forming apparatus 200E according to the present example, in the same way as the image forming apparatus 100E according to the first example, performs the processes at steps S1101 to S1103 in FIG. 11, and the process proceeds to step S1104 (step S1301 in FIG. 13).

The image forming apparatus 200E calculates the quantity of the preprocess liquid and the quantity of the postprocess liquid, by using the control unit 70 (step S1301 (step S1104)). The control unit 70 according to the present variation, using the input ink information, further calculates the permeability of ink on the recording medium and the glossiness of ink on the recording medium.

Specifically, the control unit 70, at first, outputs the kind of ink or the like from the HDD 71*d* or the like of the higher-level device 71 (step S1301). Next, the control unit 70, based on the kind of ink and the quantity of the preprocess liquid, calculated at step S1104 and referred to at step S1302, calculates the quantity of the postprocess liquid in the postprocessing unit 50 (step S1303). Next, the control unit 70, based on the quantity of the preprocess liquid referred to at step S1302 and the quantity of the postprocess liquid calculated at step S1303, calculates the preprocess liquid desiccation quantity (step S1304) and calculates the postprocess liquid desiccation quantity (step S1305). That is, the control unit 70 (image forming apparatus 200E) calculates the application quantity of the preprocess liquid according to the kind of ink, and calculates the discharge quantity of the postprocess liquid according to the application quantity of the preprocess liquid. The control unit 70 then further according to the kind of ink, can adjust (recalculate) the calculated discharge quantity of the postprocess liquid.

Accordingly, the image processing apparatus 200E according to the present variation can increase the discharge quantity of the postprocess liquid, even if the quantity of the preprocess liquid may be small according to the kind of ink. The image forming apparatus 200E can increase the discharge quantity of the postprocess liquid, for example, in the case that a glossiness of a region, where an image is formed with ink on a recording medium with high glossiness, is degraded, and when difference between a region where the image is not formed and the region where the image is formed becomes noticeable. Moreover, even if the discharge quantity of the postprocess liquid is increased so as to reduce the cost of the preprocess liquid, the image forming apparatus 200E can reduce the difference between the glossiness of the region where the image is formed and the glossiness of the region where the image is not formed. Accordingly, the image forming apparatus 200E can reduce the cost of the preprocess liquid and can form an image with excellent image quality.

Moreover, with the image forming apparatus 200E according to the present variation, the blurring due to agglutination of color material can be suppressed by the application of the preprocess liquid, and the abrasion resistance of the image can be enhanced and the unevenness of glossiness can be reduced by the discharge of the postprocess liquid. In addition, the image forming apparatus 200E can control the application quantity of the preprocess liquid, the discharge quantity of the postprocess liquid, the desiccation intensity after the application of the preprocess liquid and the desiccation intensity after the discharge of the postprocess liquid according to the kind of the recording medium. Accordingly, the image forming apparatus 200E can suppress non-attainment of target image quality, rub resistance or the like due to insufficient adhesion of the preprocess liquid or the postprocess liquid, the degradation of printing quality due to insufficient desiccation, an occurrence of shrinkage of paper due to an excess of desiccation, or the like. That is, the image forming apparatus 200E can always form an image with high quality and toughness regardless of a kind of the recording medium.

After calculating the quantity of the preprocess liquid, the quantity of the postprocess liquid, the preprocess liquid desiccation intensity and the postprocess liquid desiccation intensity, the process of the image forming apparatus 200E returns to step S1105 in FIG. 11.

The image forming apparatus 200E, in the same way as the image forming apparatus 100E according to the first example, performs the processes at steps S1101 to S1103 in FIG. 11. Afterward, the process of the image forming apparatus 200E proceeds to END in FIG. 11, and the operation of forming an image ends.

As described above, the image forming apparatus 200E according to the variation of the first example of the present invention can obtain the same effect as the image forming apparatus 100 according to the embodiment and the image forming apparatus 100E according to the first example.

Second Example

The present invention will be explained by using a print apparatus 300E according to a second example.

(Configuration of Image Forming Apparatus)

The configuration of the print apparatus 300E according to the present example will be explained. The configuration of the print apparatus 300E according to the present example includes the configuration of the image forming apparatus 100 according to the embodiment, and a different part will be mainly explained.

The print apparatus 300E according to the present example includes, as an image forming unit, plural photoreceptors corresponding to respective colors, a charge unit, an exposure unit and a developing unit. Moreover, the print apparatus 300E includes an intermediate transfer belt, a secondary transfer roller, a fixing unit, a cleaning unit, or the like. Furthermore, the print apparatus 300E may further include a feed unit that stores and feeds a paper on which an image is to be formed, a readout unit that reads an image (image data) described (formed) on a manuscript, or the like.

The print apparatus 300E includes, as the image forming unit, plural developing devices, which include photoreceptors forming toner images of different colors or the like, and print (form) color images on a recording medium stored in the feed unit.

For each color, the respective charge unit charges uniformly the surface of the rotating photoreceptor. The exposure unit, for example, based on image data or the like read out from a manuscript placed on an ADF (Automatic Document Feeder) by the readout unit, exposes the surface of the photoreceptor and generates an electrostatic latent image.

The developing unit develops the electrostatic latent image on the surface of the photoreceptor using developer, and forms a toner image. On the intermediate transfer belt, after the image forming unit (plural developing devices) forms toner images with different colors, the toner images are overlapped on each other, then are transferred.

The fixing unit heats and pressurizes the recording medium on which the toner image is transferred. The heated and pressurized toner image is fixed on the surface of the recording medium.

The cleaning unit cleans the photoreceptor after the toner image is transferred to the intermediate transfer belt. The print apparatus 300E removes residual toner after the transfer on the surface of the photoreceptor by using the cleaning unit, and prepares for the next print (image formation).

The feed unit stores and feeds the recording medium (for example, a paper) on which an image is formed. For the feed unit according to the present example, the import unit 10 of the image forming apparatus 100 according to the embodiment is used.

(Operation of Printing in Print Apparatus)

The operation of printing an image on a recording medium in the print apparatus 300E according to the present example will be explained.

The print apparatus 300E according to the present example, at the start of print, at first, transports plural recording media (for example, papers) continuously. The print apparatus 300E then, as the preprocess step, using the preprocessing unit 20, performs the preprocess for the plural recording media transported continuously. That is, the print apparatus 300E applies preprocess liquid on surfaces of the recording media. The print apparatus 300E, at the preprocess step, applies the preprocess liquid, an application quantity of which is determined based at least on the kind of toner (or ink). Moreover, the print apparatus 300E may use, for example, clear toner for the preprocess liquid.

Moreover, the print apparatus 300E, as the preprocess liquid desiccation step, using the preprocess liquid desiccation unit 31, desiccates sequentially the plural preprocessed recording media. The print apparatus 300E, at the preprocess liquid desiccation step, controls the preprocess liquid desiccation strength based on the kind of toner (or ink). The print apparatus 300E according to the present example controls the preprocess liquid desiccation strength based on the kind of the clear toner, and fixes the clear toner. Accordingly, the print apparatus 300E can enhance the quality of formed image, the water resistance, the weather resistance and/or the toughness of image.

Next, the print apparatus 300E, as the image forming step, using the charge unit, uniformly charges the surface of the photoreceptor, and creates an electrostatic latent image on the surface of the photoreceptor by using the exposure unit. Moreover, the print apparatus 300E, as the image forming step, by using the developing unit, develops the electrostatic latent image on the surface of the photoreceptor, forms a toner image, and transfers the toner image on the rotating intermediate transfer belt. The plural toner images on the intermediate transfer belt are overlapped on each other. The print apparatus 300E then, as the image forming step, transfers the toner image from the intermediate transfer belt onto the preprocessed recording medium, and fixes the transferred toner image by using the fixing unit.

Next, the print apparatus 300E, as the postprocess step, by using the postprocessing unit, performs sequentially the postprocess for the plural recording media, on which the toner images are fixed. That is, the print apparatus 300E discharges the postprocess liquid, which is different from the preprocess liquid, on the surfaces of the recording media. The print apparatus 300E, at the postprocess step, discharges the postprocess liquid, a discharge quantity of which is determined based at least on the kind of the toner (or ink). Moreover, the print apparatus 300E may use, for example, clear toner for the postprocess liquid.

Moreover, the print apparatus 300E, as the postprocess liquid desiccation step, by using the postprocess liquid desiccation unit 32, desiccates sequentially the plural postprocesses recording media. The print apparatus 300E, at the postprocess liquid desiccation step, based on the kind of toner (or ink), control the postprocess liquid desiccation intensity. The print apparatus 300E according to the present example controls the postprocess liquid desiccation intensity based on the kind of the clear toner, and fixes the clear toner. Accordingly, the print apparatus 300E can enhance the quality of formed image, the water resistance, the weather resistance and/or the toughness of image.

The print apparatus 300E then, by using the export unit 60, exports the printed matter (recording medium), on which the image is printed. The printed matter, which the print apparatus 300E according to the second example prints, has, for example, a cross-sectional shape, as shown in FIG. 6.

As stated above, the print apparatus 300E according to the second example of the present invention can obtain the same effect as the image forming apparatus 100 according to the embodiment.

In the present examples, the postprocessing unit 50 discharges the postprocess liquid. But, the present invention is not limited to this. The postprocessing unit 50 may apply the postprocess liquid onto the surface of the recording medium.

Further, the present invention is not limited to these embodiments and examples, but various variations and modifications may be made without departing from the scope of the present invention.

The present application is based on and claims the benefit of priority of Japanese Priority Application No. 2013-044664 filed on Mar. 6, 2013, with the Japanese Patent Office, the entire contents of which are hereby incorporated by reference.

What is claimed is:

1. An image forming apparatus which discharges ink onto a recording medium to form an image on a surface of the recording medium, comprising:

a preprocessing unit configured to apply preprocess liquid to the surface of the recording medium before the image is formed;

a postprocessing unit configured to discharge postprocess liquid on the recording medium after the image is formed the postprocess liquid being different from the preprocess liquid, and the postprocess liquid being discharged in a spot or stripe shape having a predetermined height on the image; and a control unit configured to determine an amount of the preprocess liquid to apply based on a type of ink to form the image, and to determine an amount of the postprocess liquid to discharge based on the amount of the preprocess liquid to apply.

2. The image forming apparatus as claimed in claim 1, wherein the postprocessing unit includes a discharger that discharges the postprocess liquid from a nozzle, and the discharger controls the amount of the postprocess liquid based on a drive waveform which is input to the discharger.

3. The image forming apparatus as claimed in claim 1, further comprising:

a preprocess liquid desiccation unit that desiccates the surface of the recording medium on which the preprocess liquid is applied; and a postprocess liquid desiccation unit that desiccates the surface of the recording medium on which the postprocess liquid is applied, wherein the preprocess liquid desiccation unit controls an intensity of desiccation based on the kind of the ink, and the postprocess liquid desiccation unit controls an intensity of desiccation based on the kind of the ink.

4. The image forming apparatus as claimed in claim 3, wherein the preprocess liquid desiccation unit is configured to control the intensity of desiccation based on the amount of the preprocess liquid per unit area on the surface of the recording medium.

5. The image forming apparatus as claimed in claim 3, wherein the postprocess liquid desiccation unit is configured to control an intensity of desiccation based on the amount of the postprocess liquid per unit area on the surface of the recording medium.

6. The image forming apparatus as claimed in claim 3, wherein the preprocess liquid desiccation unit is configured to decrease the intensity of desiccation when the ink has a low permeability, to increase the intensity of desiccation when the ink has a high permeability, and the postprocess liquid desiccation unit is configured to decrease the intensity of desiccation when the ink has a low permeability, and to increase the intensity of desiccation when the ink has a high permeability.

7. An image forming system, comprising:

the image forming apparatus as claimed in claim 1;

an import device that imports the recording medium, before the image is formed, into the image forming apparatus;

an export device that exports the recording medium, after the image is formed, from the image forming apparatus; and a control device that controls operations of the image forming apparatus, the import device and the export device by wired and/or wireless methods.

8. The image forming apparatus as claimed in claim 1, wherein:

the control unit is configured to receive user input data regarding a permeability of the ink on the recording medium, and to calculate the amount of the postprocess liquid based on the user input data.

9. The image forming apparatus as claimed in claim 1, wherein the control unit is configured to receive user input data regarding a glossiness of the ink on the recording medium, and to calculate the amount of the postprocess liquid based on the user input data.

10. The image forming apparatus as claimed in claim 1, wherein the control unit is configured to direct the postprocessing unit to discharge the amount of the postprocess liquid based on a combination of the type of ink that forms the image, the type of the recording image, and an application quantity of the preprocess liquid.

11. The image forming apparatus as claimed in claim 1, wherein the postprocessing unit includes a discharge head to eject the postprocess liquid onto the recording medium in a spot shape.

12. The image forming apparatus as claimed in claim 1, wherein the control unit is configured to direct the amount of thickness of the postprocess liquid on the recording medium based on the combination of the type of the ink that forms the image and the type of the recording medium.

13. An image forming method, comprising:

applying preprocess liquid on a surface of a recording medium;

forming an image with ink on the surface of the recording medium on which the preprocess liquid is applied, an application quantity of the preprocess liquid being determined based at least on a kind of the ink; and discharging postprocess liquid in a spot or stripe shape having a predetermined height on top of the image, the postprocess liquid being different from the preprocess liquid, and an amount of the postprocess liquid being based on an amount of preprocess liquid applied to the recording medium.

14. The image forming method as claimed in claim 13, wherein the application quantity of the postprocess liquid is increased in a case where a glossiness of the recording medium on which the image is formed is to be enhanced.

15. The image forming method as claimed in claim 13, further comprising:

desiccating the recording medium on which the preprocess liquid is applied with a preprocess liquid desiccation intensity, which is controlled based on the kind of the ink; and desiccating the recording medium on which the postprocess liquid is applied with a postprocess liquid desiccation intensity, which is controlled based on the kind of the ink.

16. The image forming method as claimed in claim 15, wherein the preprocess liquid desiccation intensity is controlled further using an application quantity of the preprocess liquid per unit area on the surface of the recording medium, and the postprocess liquid desiccation intensity is controlled further using an application quantity of the postprocess liquid per unit area on the surface of the recording medium.

17. A printing method of printing printed matter on a recording medium with toner or ink, comprising:

applying a preprocess liquid on a surface of the recording medium, an application quantity of the preprocess liquid being determined based at least on a kind of the toner or the ink;

forming an image on the surface of the recording medium with the toner or the ink, on which the preprocess liquid is applied; and discharging a postprocess liquid in a spot or stripe shape having a predetermined height on top of the image, the postprocess liquid being different from the preprocess liquid, and an amount of the postprocess liquid being based on an amount of preprocess liquid applied to the recording medium.

18. The printing method of printed matter, as claimed in claim 17, further comprising:

desiccating the recording medium on which the preprocess liquid is applied, with a preprocess liquid desiccation intensity which is controlled based on the kind of the toner or the ink; and desiccating the recording medium on which the postprocess liquid is applied, with a postprocess liquid desiccation intensity which is controlled based on the kind of the toner or the ink.

19. The printing method of printed matter, as claimed in claim 18, wherein the preprocess liquid or the postprocess liquid is a clear toner, and the preprocess liquid desiccation intensity or the postprocess liquid desiccation intensity is controlled based on a kind of the clear toner, to fix the clear toner, so as to enhance a quality, a water resistance, a weather resistance and/or a toughness of the formed image.

* * * * *